US011817630B2

(12) United States Patent
Hu et al.

(10) Patent No.: US 11,817,630 B2
(45) Date of Patent: Nov. 14, 2023

(54) SUBSTRATE INTEGRATED WAVEGUIDE-FED FABRY-PEROT CAVITY FILTERING WIDEBAND MILLIMETER WAVE ANTENNA

(71) Applicant: City University of Hong Kong, Hong Kong (HK)

(72) Inventors: Haotao Hu, Hong Kong (HK); Chi Hou Chan, Hong Kong (HK)

(73) Assignee: City University of Hong Kong, Hong Kong (HK)

( * ) Notice: Subject to any disclaimer, the term of this patent is extended or adjusted under 35 U.S.C. 154(b) by 59 days.

(21) Appl. No.: 17/477,578

(22) Filed: Sep. 17, 2021

(65) Prior Publication Data

US 2023/0092871 A1 Mar. 23, 2023

(51) Int. Cl.
*H01Q 19/185* (2006.01)
*H01Q 21/06* (2006.01)
(Continued)

(52) U.S. Cl.
CPC ..... *H01Q 21/065* (2013.01); *H01P 1/2088* (2013.01); *H01Q 15/006* (2013.01); *H01Q 19/185* (2013.01)

(58) Field of Classification Search
CPC .. H01Q 21/065; H01Q 15/006; H01Q 19/185; H01Q 1/38; H01Q 9/0407; H01P 1/2088
See application file for complete search history.

(56) References Cited

U.S. PATENT DOCUMENTS 5,949,387 A 9/1999 Wu et al.
8,284,001 B2 10/2012 Bourtoutian
(Continued)

FOREIGN PATENT DOCUMENTS

CN 102394365 A 3/2012
CN 202275943 U 6/2012
(Continued)

OTHER PUBLICATIONS

Gao et al, Low-Profile Circularly Polarized Fabry-Perot Resonator Antenna Array with Substrate Integrated Waveguide Feed Network, 2017, IEEE 5th International Symposium on Electromagnetic Compatibility (EMC-Beijing), pp. 1-3 (Year: 2017).*
(Continued)

*Primary Examiner* — Ab Salam Alkassim, Jr.
*Assistant Examiner* — Anh N Ho
(74) *Attorney, Agent, or Firm* — Idea Intellectual Limited; Margaret A. Burke; Sam T. Yip

(57) ABSTRACT

The present invention provides wideband millimeter-wave SIW-fed FPC filtering antenna comprising a partially reflecting surface (PRS) and a filtering source configured to radiate a millimeter-wavelength electromagnetic wave. The filtering source comprises a conductive reflecting plane configured to work with the PRS to form a Fabry-Perot cavity; radiating elements including a pair of shorted radiating patches electrically connected to a ground plane through a pair of probes; and a substrate integrated waveguide (SIW) feeding structure coupled to the pair of radiating patches through a coupling aperture. The SIW-fed FPC filtering antenna has the advantages of wider bandwidth, higher directivity/gain, reduced structural complexity, compact size and appropriate feeding type for millimeter-wave applications.

9 Claims, 24 Drawing Sheets
(6 of 24 Drawing Sheet(s) Filed in Color)

(51) Int. Cl.
*H01P 1/208* (2006.01)
*H01Q 15/00* (2006.01)

(56) References Cited

U.S. PATENT DOCUMENTS

| | | | | |
|---|---|---|---|---|
| 8,665,158 | B2 | 3/2014 | Chung et al. | |
| 8,836,596 | B2 | 9/2014 | Richards et al. | |
| 8,860,532 | B2 | 10/2014 | Gong et al. | |
| 8,952,858 | B2 | 2/2015 | de Rochemont | |
| 9,653,793 | B2 | 5/2017 | Tawk et al. | |
| 9,799,952 | B2 | 10/2017 | Bojer | |
| 9,941,596 | B2 | 4/2018 | Zhang et al. | |
| 10,008,781 | B1 | 6/2018 | Pan et al. | |
| 10,333,225 | B1 | 6/2019 | Kanagasabai et al. | |
| 10,347,990 | B2 | 7/2019 | Zhang et al. | |
| 10,727,555 | B2 | 7/2020 | Hendry | |
| 10,727,600 | B1 | 7/2020 | Saeidi et al. | |
| 10,797,657 | B2 | 10/2020 | Takenaka et al. | |
| 10,797,809 | B2 | 10/2020 | Charbit et al. | |
| 10,804,988 | B2 | 10/2020 | Gupta et al. | |
| 10,833,417 | B2 | 11/2020 | Leung et al. | |
| 10,833,903 | B2 | 11/2020 | To et al. | |
| 10,834,534 | B2 | 11/2020 | Kim et al. | |
| 10,854,960 | B2 | 12/2020 | Bean | |
| 10,879,875 | B2 | 12/2020 | Nielsen et al. | |
| 10,886,609 | B2 | 1/2021 | Lenive et al. | |
| 10,886,963 | B2 | 1/2021 | Sengupta et al. | |
| 10,991,549 | B2 | 4/2021 | Ikeda et al. | |
| 11,012,159 | B2 | 5/2021 | Schuetz et al. | |
| 11,012,865 | B2 | 5/2021 | Macmullan et al. | |
| 2016/0365638 | A1* | 12/2016 | Luk | H01Q 9/285 |
| 2018/0034156 | A1* | 2/2018 | Zhang | H01Q 1/523 |

FOREIGN PATENT DOCUMENTS

| | | | | | |
|---|---|---|---|---|---|
| CN | 108232439 | A | * | 6/2018 | |
| CN | 108923126 | A | | 11/2018 | |
| CN | 110544822 | A | | 12/2019 | |
| CN | 112838376 | A | * | 5/2021 | H01Q 1/36 |
| CN | 112886272 | A | * | 6/2021 | H01Q 1/36 |
| CN | 113054425 | A | * | 6/2021 | H01P 1/207 |
| CN | 113300108 | A | * | 8/2021 | |

OTHER PUBLICATIONS

Hao-Tao Hu et al., 60-GHz Fabry-Perot Cavity Filtering Antenna Driven by an SIW-Fed Filtering Source, IEEE Transactions on Antennas and Propagation , vol. 70, Issue: 2, Feb. 2022, p. 823-834.

B. P. Chacko, G. Augustin, and T. A. Denidni, "FPC antennas: C-band point-to-point communication systems," IEEE Antennas Propag. Mag., vol. 58, No. 1, pp. 56-64, Feb. 2016.

M. S. Rabbani, J. Churm, and A.P. Feresidis, "Fabry-Perot beam scanning antenna for remote vital sign detection at 60 Ghz," IEEE Trans. Antennas Propag., early accepted.

S. A. Hosseini, F. Capolino, and F. D. Flaviis, "Q-Band single-layer planar Fabry-Perot cavity antenna with single integrated-feed," Progress in Electromagnetics Research C, vol. 52, pp. 135-144, 2014.

P. P. Shome, T. Khan, S. K. Koul and Y. Antar, "Filtenna designs for radio-frequency front-end systems: a structural-oriented review," IEEE Antennas Propag. Mag., early accepted.

G. V. Trentini, "Partially reflecting sheet arrays," IRE Trans. Antennas Propag., vol. 4, No. 4, pp. 666-671, Oct. 1956.

A. P. Feresidis, G. Goussetis, S. Wang, and J. C. Vardaxoglou, "Artificial magnetic conductor surfaces and their application to low-profile high-gain planar antennas," IEEE Trans. Antennas Propag., vol. 53, No. 1, pp. 209-215, Jan. 2005.

S. J. Franson and R. W. Ziolkowski, "Gigabit per second data transfer in high-gain metamaterial structures at 60 GHz," IEEE Trans. Antennas Propag., vol. 57, No. 10, pp. 2913-2925, Oct. 2009.

C. Mateo-Segura, G. Goussetis, and A. P. Feresidis, "Sub-wavelength profile 2-D leaky-wave antennas with two periodic layers," IEEE Trans. Antennas Propag., vol. 59, No. 2, pp. 416-424, Feb. 2011.

R. Orr, G. Goussetis, and V. Fusco, "Design method for circularly polarized Fabry-Perot cavity antennas," IEEE Trans. Antennas Propag., vol. 62, No. 1, pp. 19-26, Jan. 2014.

C. Mateo-Segura, A. P. Feresidis, and G. Goussetis, "Bandwidth enhancement of 2-D leaky-wave antennas with double-layer periodic surfaces," IEEE Trans. Antennas Propag., vol. 62, No. 2, pp. 586-593, Feb. 2014.

K. Konstantinidis, A. P. Feresidis, and P. S. Hall, "Multilayer partially reflective surfaces for broadband Fabry-Perot cavity antennas," IEEE Trans. Antennas Propag., vol. 62, No. 7, pp. 3474-3481, Jul. 2014.

K. Konstantinidis, A. P. Feresidis, and P. S. Hall, "Broadband sub-wavelength profile high-gain antennas based on multi-layer metasurfaces," IEEE Trans. Antennas Propag., vol. 63, No. 1, pp. 423-427, Jan. 2015.

H. Attia, M. L. Abdelghani, and T. A. Denidni, "Wideband and high-gain millimeter-wave antenna based on FSS Fabry-Perot cavity," IEEE Trans. Antennas Propag., vol. 65, No. 10, pp. 5589-5594, Oct. 2017.

P.-Y. Qin, L-Y. Ji, S.-L. Chen, and Y. J. Guo, "Dual-polarized wideband Fabry-Perot antenna with quad-layer partially reflective surface," IEEE Antennas Wireless Propag. Lett., vol. 17, No. 4, pp. 551-554, Apr. 2018.

J. Zhang, S. Zhang, and G. F. Pedersen, "Dual-band structure reused antenna based on quasi-elliptic bandpass frequency selective surface for 5G application," IEEE Trans. Antennas Propag., vol. 68, No. 11, pp. 7612-7617, Nov. 2020.

M. M. Honari, P. Mousavi, and K. Sarabandi, "Miniaturized-element frequency selective surface metamaterials: a solution to enhance radiation of RFICs," IEEE Trans. Antennas Propag., vol. 68, No. 3, pp. 1962-1972, Mar. 2020.

Z. Liu, S. Liu, X. Zhao, X. Kong, Z. Huang, and B. Bian, "Wideband gain enhancement and RCS reduction of Fabry-Perot antenna using hybrid reflection method," IEEE Trans. Antennas Propag., vol. 68, No. 9, pp. 6497-6505, Sep. 2020.

Y. Yusuf and X. Gong, "Compact low-loss integration of high-Q 3-D filters with highly efficient antennas," IEEE Trans. Microw. Theory Tech., vol. 59, No. 4, pp. 857-865, Apr. 2011.

Y. Yusuf, H. Cheng, and X. Gong, "A seamless integration of 3-D vertical filters with highly efficient slot antennas," IEEE Trans. Antennas Propag., vol. 59, No. 11, pp. 4016-4022, Nov. 2011.

Y. Yusuf, H. Cheng, and X. Gong, "Co-designed substrate-integrated waveguide filters with patch antennas," IET Microw. Antennas Propag., vol. 7, No. 7, pp. 493-501, Jul. 2013.

H. Chu, C. Jin, J-X. Chen, and Y.-X. Guo, "A 3-D millimeter-wave filtering antenna with high selectivity and low cross-polarization," IEEE Trans. Antennas Propag., vol. 59, No. 11, pp. 2375-2380, May 2015.

H. Chu, J.-X. Chen, S. Luo, and Y.-X. Guo, "A millimeter-wave filtering monopulse antenna array based on substrate integrated waveguide technology," IEEE Trans. Antennas Propag., vol. 64, No. 1, pp. 316-321, Jan. 2016.

H. Chu and Y.-X. Guo, "A filtering dual-polarized antenna subarray targeting for base stations in millimeter-wave 5G wireless communications," IEEE Trans. Compon. Packag. Manuf. Technol, vol. 7, No. 6, pp. 964-973, Jun. 2017.

K. Xu, J. Shi, X. Qing, and Z. N. Chen, "A substrate integrated cavity backed filtering slot antenna stacked with a patch for frequency selectivity enhancement," IEEE Antennas Wireless Propag. Lett., vol. 17, No. 10, pp. 1910-1914, Oct. 2018.

K.-Z. Hu, M.-C. Tang, M. Li, and R. W. Ziolkowski, "Compact, low-profile, bandwidth-enhanced substrate integrated waveguide filtenna," IEEE Antennas Wireless Propag. Lett., vol. 17, No. 8, pp. 1552-1556, Aug. 2018.

P. K. Li, C. J. You, H. F. Yu, X. Li, Y. W. Yang, and J. H. Deng, "Codesigned high-efficiency single-layered substrate integrated waveguide filtering antenna with a controllable radiation null," IEEE Antennas Wireless Propag. Lett., vol. 17, No. 2, pp. 295-298, Feb. 2018.

(56) References Cited

OTHER PUBLICATIONS

K.-Z. Hu, M.-C. Tang, D. Li, Y. Wang, and M. Li, "Design of compact, single-layered substrate integrated waveguide filtenna with parasitic patch," IEEE Trans. Antennas Propag., vol. 68, No. 2, pp. 1134-1139, Feb. 2020.

X. Liu, X. Zhang, K. Xu, and J. Shi, "A filtering antenna with high frequency selectivity using stacked dual-slotted substrate integrated cavities," IEEE Antennas Wireless Propag. Lett., vol. 19, No. 8, pp. 1311-1315, Aug. 2020.

C. Fan, B. Wu, Y.-L. Wang, H.-Y. Xie, and T. Su, "High-gain SIW filtering antenna with low H-plane cross polarization and controllable radiation nulls," IEEE Trans. Antennas Propag., early accepted.

K.-Z. Hu, M.-C. Tang, Y. Wang, D. Li, and M. Li, "Compact, vertically integrated duplex filtenna with common feeding and radiating SIW cavities," IEEE Trans. Antennas Propag., vol. 69, No. 1, pp. 502-507, Jan. 2021.

* cited by examiner

Design I

Design II

Design III

Design IV

SUBSTRATE INTEGRATED WAVEGUIDE-FED FABRY-PEROT CAVITY FILTERING WIDEBAND MILLIMETER WAVE ANTENNA

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention generally relates to wideband self-filtering antennas and, more particularly, to a substrate integrated waveguide (SIW)-fed Fabry-Perot cavity (FPC) self-filtering antenna for wideband millimeter-wave (mm-wave) applications.

BACKGROUND OF THE INVENTION

Fabry-Perot cavity (FPC) antennas possess the merits of a low-loss feeding scheme, low fabrication complexity, and being light weight in addition to high directivity. Due to these characteristics, the FPC antenna can be found in a wide range of applications. To design Fabry-Perot cavity (FPC) antennas with a filtering response, the most traditional method is introducing frequency selective surfaces (FSSs), as shown in FIG. 1. To achieve a good filtering response, the FSSs are always constructed with multiple substrate layers. Due to the use of multiple FSSs as well as the intrinsic narrow working bandwidth of the FSS, these kinds of FPC antennas usually suffer the drawbacks of having a high profile and limited bandwidth. Furthermore, the assembly complexity is increased and the designed antennas usually suffer additional insertion loss introduced by the FSSs.

Due to the merits of low insertion loss, high power capacity, and ease of integration, substrate integrated waveguide (SIW) technology is being developed for high-performance microwave/millimeter-wave components such as filters and antennas. Conventionally, filters and antennas were separately designed and connected with transmission lines. However, this architecture suffers from a large size as well as significant insertion loss introduced by the filter and its connection circuits. To achieve compact size, half-mode SIW cavities are used to work as the resonators in some antenna designs. For the purpose of introducing radiation nulls, mutual coupling techniques have also been utilized to improve the selectivity. However, these approaches suffer from limited bandwidth or inappropriate feeding type for mm-wave operation. Moreover, since the electromagnetic (EM) waves of mm-wave frequencies suffer from high propagation losses, high directivity/gain antennas are usually required for mm-wave systems. Thus, there is a need in the art for a different approach to antenna design in which the antenna can achieve wider bandwidth, higher directivity/gain, and more compact size and appropriate feeding type for mm-wave applications.

SUMMARY OF THE INVENTION

According to one aspect of the present invention, a novel wideband substrate integrated waveguide (SIW)-fed Fabry-Perot cavity (FPC) filtering antenna is provided for mm-wave applications. The provided antenna comprises a partially reflecting surface (PRS); and a filtering source configured to radiate a millimeter-wavelength electromagnetic wave. The filtering source comprises a conductive reflecting plane configured to work with the PRS to form a Fabry-Perot cavity; radiating elements including a pair of shorted radiating patches, each electrically connected to a respective ground plane through a respective probe pin; and a substrate integrated waveguide (SIW) feeding structure coupled to the pair of radiating patches through a coupling aperture.

Compared to using conventional microstrip-feeding connection and frequency selective surfaces, the SIW-fed FPC filtering antenna has the advantages of wider bandwidth, higher directivity/gain, reduced structural complexity, compact size and appropriate feeding type for mm-wave applications.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Embodiments of the invention are described in more detail hereinafter with reference to the drawings, in which.

DETAILED DESCRIPTION

In the following description, a millimeter-wave substrate integrated waveguide (SIW)-fed Fabry-Perot cavity (FPC) filtering antenna and a method for manufacturing the same are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Figure 1:
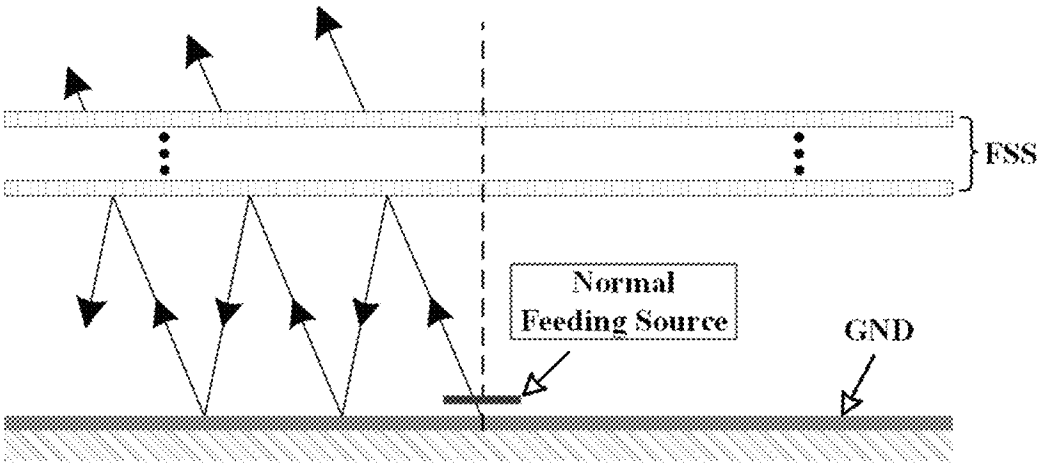
FIG. 1 depicts a traditional design for Fabry-Perot cavity (FPC) antenna using frequency selective surfaces (FSSs)
Figure 2:
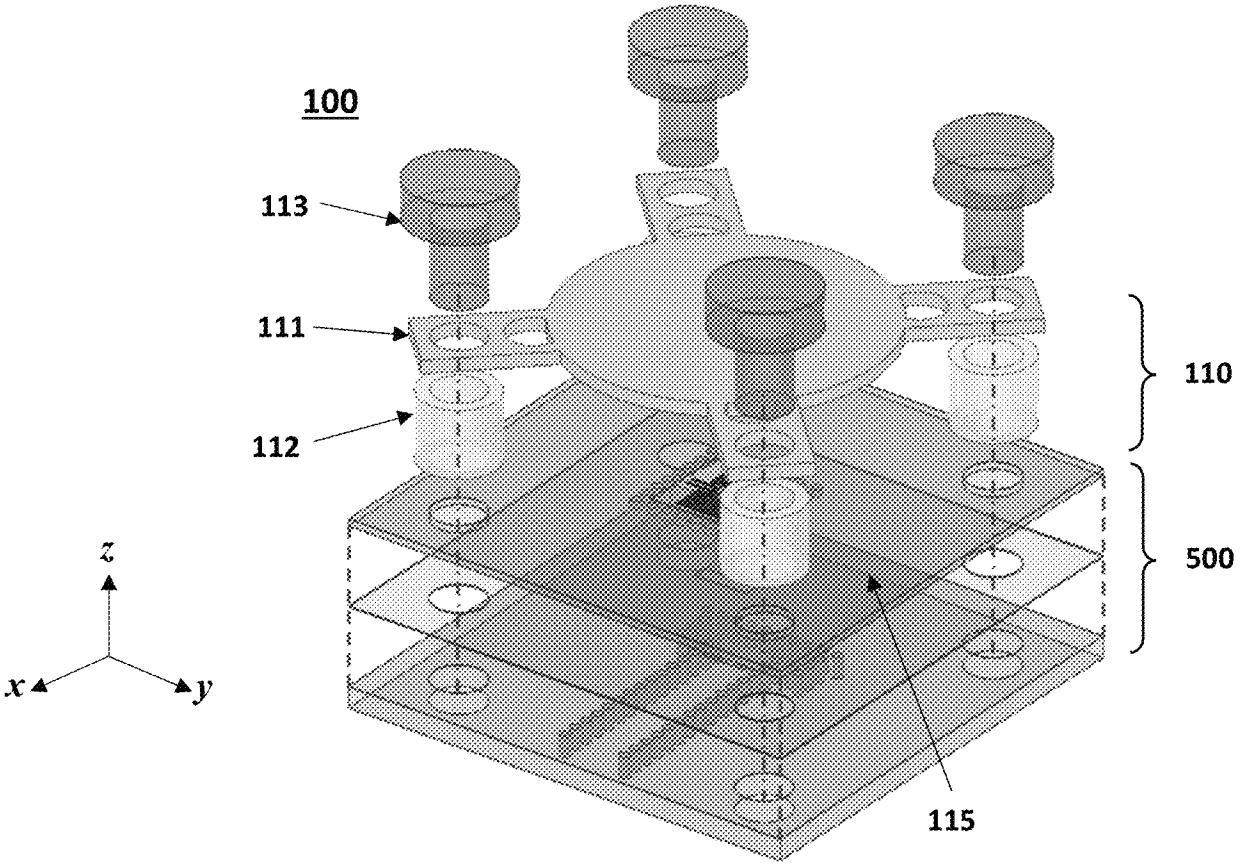
FIG. 2 depicts an isometric exploded view of a millimeter-wave SIW-fed FPC filtering antenna according to one embodiment of the present invention.
Figure 3:
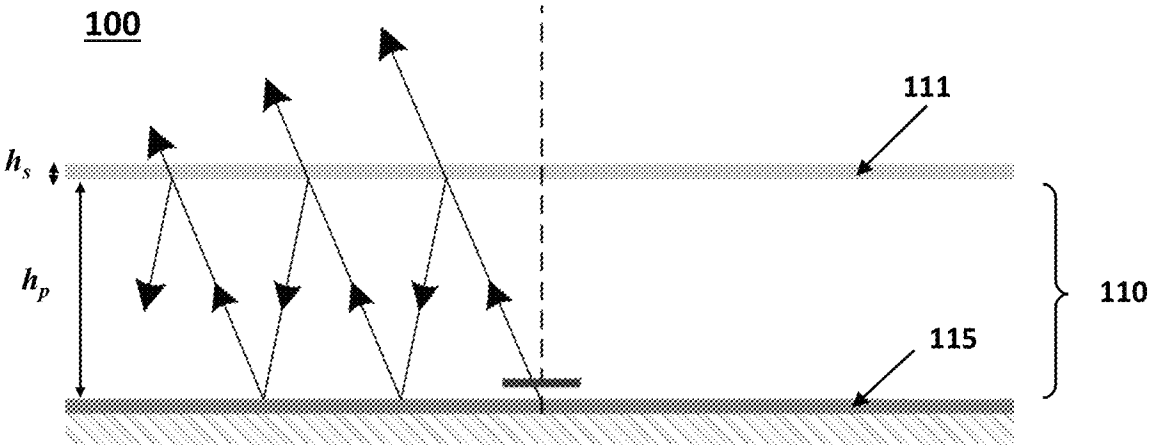
FIG. 3 depicts the detailed design of the FPC formed with the PRS and filtering source 500.

FIG. 2 depicts an isometric exploded view of a millimeter-wave SIW-fed FPC filtering antenna 100 according to one embodiment of the present invention. FIG. 3 depicts the simplified side view of the millimeter-wave SIW-fed FPC filtering antenna 100. Referring to FIGS. 2 and 3. The filtering antenna 100 may comprise a Fabry-Perot cavity (FPC) 110 constructed with a partially reflecting surface (PRS) 111 and a conductive reflecting plane 115 (or a ground plane) from a filtering source 500. The electromagnetic wave emitted from the filtering source 500 bounces back and forth between the ground plane 115 and PRS 111, finally creating an in-phase superposition of waves transmitting through the PRS 111.

Unlike the traditional design, the provided SIW-fed FPC filtering antenna 100 simply utilizes the filtering source 500 to feed the resonant cavity and the ground plane 115 to work with the PRS 111 to obtain filtering response. Without extra substrate layers to gain the frequency selection function, the provided antenna features simple design, lower fabrication complexity and lower insertion loss. The gain enhancement, $\Delta G$, contributed by the PRS may be given by $\Delta G=10 \log((1+p)/(1-p))$, wherein p is the reflection magnitude.

Referring back to FIG. 2. The PRS 111 may have a circular shape and made of a piece of dielectric substrate. The PRS 111 may have a thickness $h_s$ that is substantially equal to a quarter guided wavelength $\lambda_g$ at the operating frequency of the antenna; an effective diameter $D_p$ equal to $2.42\lambda_0$ and a ground size $3.4\lambda_0 \times 3.42\lambda_0$, where $\lambda_0$ is the free-space wavelength at the operating frequency of the antenna. It should be understood that although the shape of the PRS 111 as depicted is circular, it may be arbitrarily selected according to different applications.

The PRS 111 may be fixed on the filtering source 500 with one or more spacers 112. Each spacer 112 may have a thickness $h_p$ for defining a distance between the PRS 111 and the ground plane 115 of the filtering source 500, that is, the cavity height of the FPC. Preferably, the spacer thickness may be equal to $0.52\ \lambda_0$ to satisfy the resonant condition of the FPC antenna.

For example, for implementing an exemplary FPC filtering antenna 100 operating at frequency of 60 GHz with a piece of Rogers Ro4360G2 substrate with dielectric constant $\varepsilon_r$ of 6.4, and loss-tangent $\delta$ of 0.0038, the thickness $h_s$ of the PRS 111 may be set to be 0.508 mm, the distance $h_p$ between the PRS 111 and the ground plane 115 may be set to be 2.6 mm; the effective diameter $D_p$ of the PRS 111 may be set to be 12 mm, and the ground size may be set to 17 mm×17 mm Moreover, four small holes near the edge of the circular PRS 111 are cut so as to minimalize the impact caused by the connection parts. The spacers 112 are fabricated by using 3-D printing. Four plastic screws 113 may be used to fix the PRS 111 on the filtering source 500.

Figure 4:
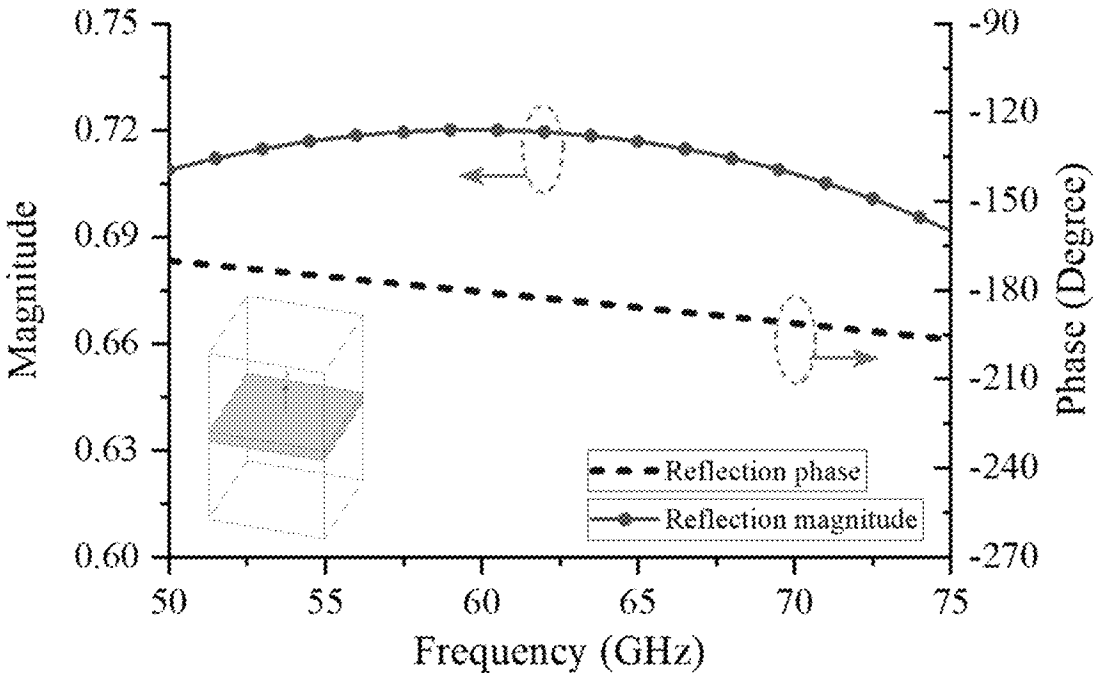
FIG. 4 shows the reflection characteristic of the PRS of the exemplary FPC filtering antenna.

FIG. 4 shows the reflection characteristic of the PRS 111 of the exemplary FPC filtering antenna 100. As seen, at 60 GHz, it has the maximum amplitude of around 0.72 and phase of −180°. It is thus expected to have a gain enhancement of 7.9 dB contributed by the PRS 111.

Figure 5A:
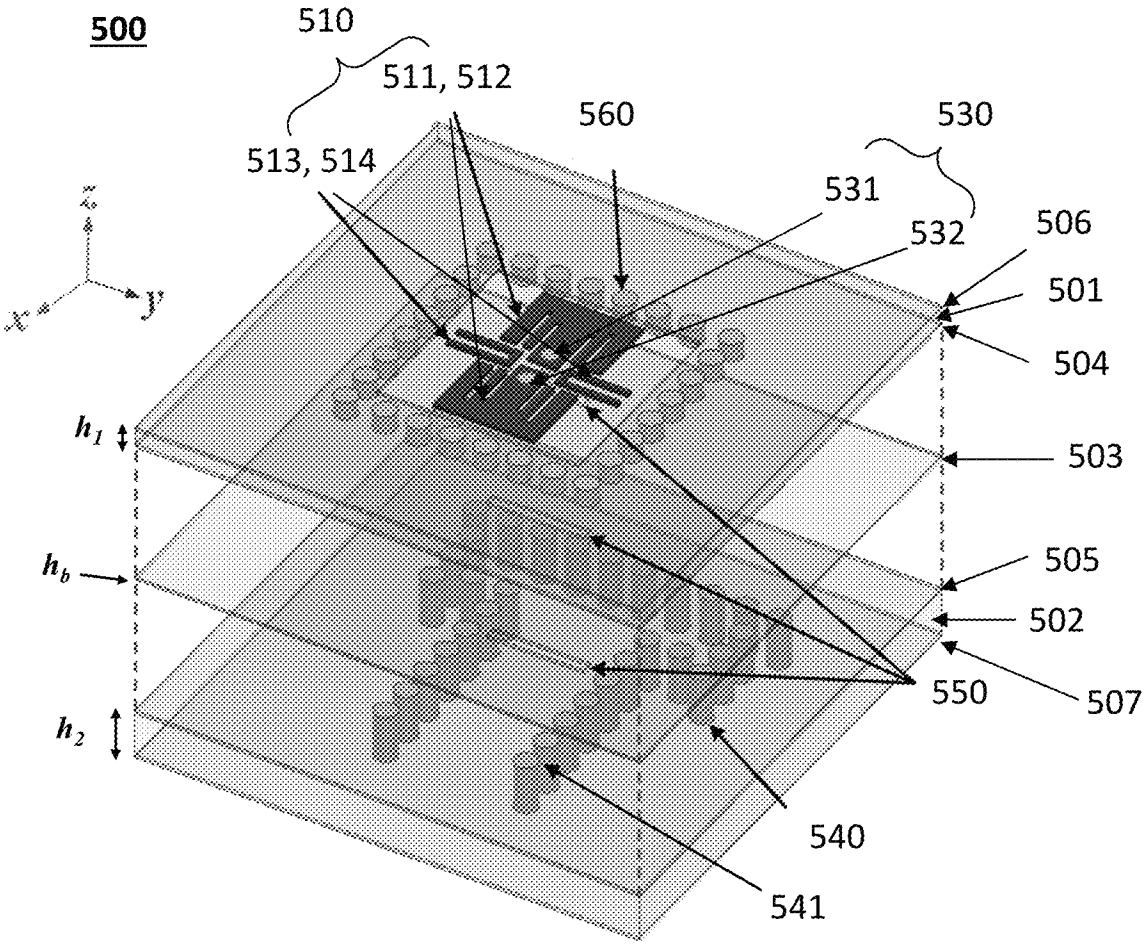
FIGS. 5A and 5B depict an isometric exploded view and a top view of the filtering source 500 according to one embodiment of the present invention respectively.
Figure 5B:
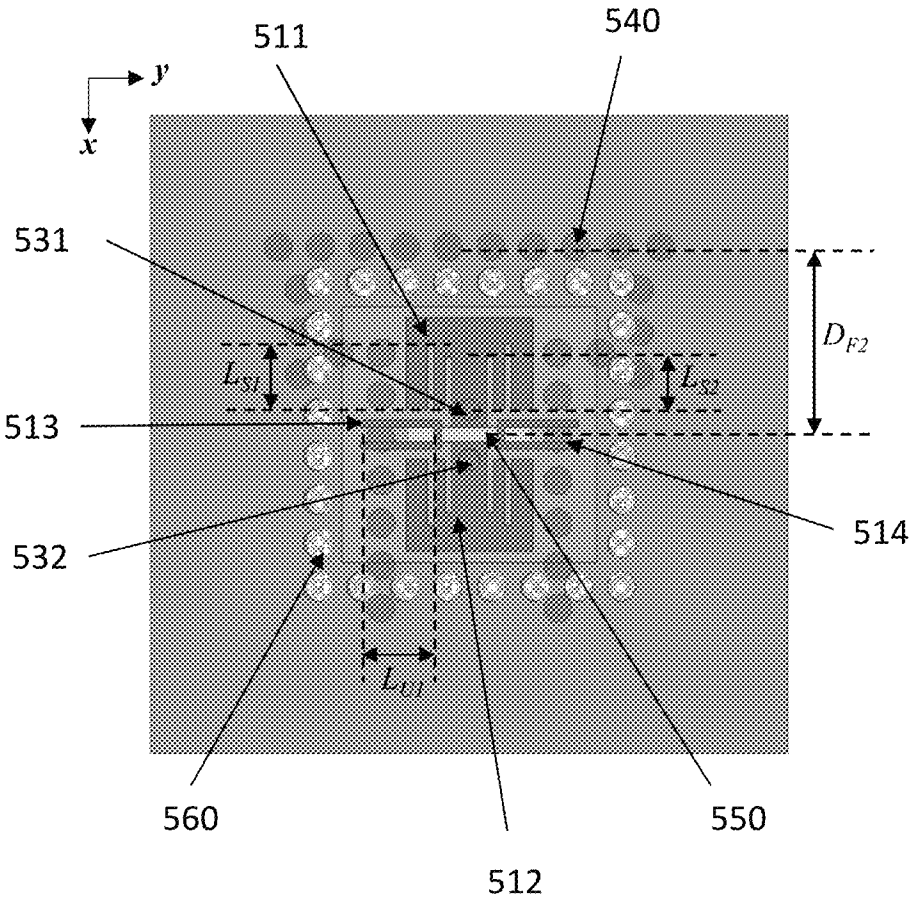

FIGS. 5A and 5B depict an isometric exploded view and a top view of the filtering source 500 respectively. The filtering source 500 may include a substrate 501, a substrate 502. Optionally, the filtering source 500 may include a bonding film 503 placed between the bottom surface of the first substrate 501 and the top surface of the substrate 502 for bonding the substrates 501 and 502 together.

In some embodiments, the substrate 501 may have a ground plane 504 on its bottom surface. The substrate 502 may have a ground plane 505 on its top surface and a ground plane 507 on its bottom surface. The ground plane 504 may act as the conductive reflecting plane 115 for forming the Fabry-Perot cavity 110.

In other embodiments, the substrate 501 may further have a ground plane 506 on its top surface. The ground plane 506 may act as the conductive reflecting plane 115 for forming the Fabry-Perot cavity 110.

Preferably, the substrates 501 and 502 may be chosen to have the same dielectric constant $\varepsilon_r$ and loss-tangent $\delta$. The substrate 501 has a thickness $h_1$ and the substrate 502 has a thickness $h_2$ which is approximately equal to three times of $h_1$ (i.e. $h_2 \approx 3\ h_1$). The bonding film 503 can be any suitable thermally and electrically conductive adhesive (TECA) bonding film with a thickness $h_b$ which is significantly smaller than $h_1$. It should be noted that the configuration described herein is for exemplary purpose. Alternatively, the substrates 501 and 502 may be chosen to have different dielectric constants and loss-tangent, and have various ratios between their thicknesses.

The filtering source 500 may comprise radiating elements 510 for radiating/receiving radio waves; probing elements 530 for coupling/connecting the radiating elements 510 to the ground plane 504/505; a feeding structure 540 for receiving/transmitting electrical signals; and a coupling aperture 550 for coupling radio signals between the feeding structure 540 and the radiating elements 510.

Preferably, the coupling aperture 550 extends from the ground plane 504 to the ground plane 505 through the bonding film 503.

The radiating elements 510 may include a pair of shorted radiating patches 511, 512 made of conductive plates formed on a top surface of the substrate 501. Preferably, the radiating patches 511, 512 are substantially identical and placed symmetrically in respect to the coupling aperture 550 so as to achieve good cross-polarization level. For instance, the radiating patches 511, 512 may be mirrored to each other about a longitudinal axis (in y-direction) of the coupling aperture 550.

The radiating elements 510 may further include a pair of conductive U-shaped hairpin lines 513, 514 formed on the top surface of the substrate 501 and positioned between the conductive slotted plates 511, 512. Preferably, the conductive U-shaped hairpin lines 513, 514 are substantially identical and placed symmetrically in respect to the coupling aperture 550 so as to achieve good cross-polarization level. For instance, each of the conductive U-shaped hairpin lines 513, 514 may have a first portion and a second portion mirrored to each other about a lateral axis (in x-direction) of the coupling aperture 550.

The probing elements 530 may include a pair of probe pins 531, 532 electrically connected to the radiating patches 511, 512, respectively. Preferably, the probe pins 531, 532 are substantially identical and placed symmetrically in respect to the coupling aperture 550 so as to achieve good cross-polarization level. For instance, the probe pins 531, 532 may be mirrored to each other about the longitudinal axis (in y-direction) of the coupling aperture 550.

Preferably, the probe pins 531, 532 are made of conductive vias extending through the substrate 501 to connect the radiating patches 511, 512 to the ground planes 504. Alternatively, the probe pins 531, 532 are made of conductive vias extending through the substrate 501 and the bonding film 503 to connect the radiating patches 511, 512, to the ground plane 505.

Optionally, the filtering source 500 may further comprise a conductive cavity 560 enclosing the radiating patches 511, 512 and U-shaped hairpin lines 513, 514 for alleviating generation of surface wave. The conductive cavity 560 may include a plurality of conductive cavity vias extending through the substrate 501, a ground plane on the top surface of substrate 501, and the ground plane 504 on the bottom surface of substrate 501. The plurality of cavity vias may be arranged in a rectangular pattern as depicted. However, it should be understood that the plurality of cavity vias may be arbitrarily arranged in any shapes or patterns for different applications.

Each of radiating patches 511, 512 may include two pairs of open slots with different lengths that may be formed by etching or by printing the radiating patches 511, 512 including the slot structure.

The longer open slots have slot lengths ($L_{S1}$) equal to a quarter-wavelength of a first null frequency at the lower stopband for generating a first radiation null; and the shorter open slots have slot lengths ($L_{S2}$) equal to a quarter-wavelength of a second null frequency at the upper stopband for generating a second radiation null.

The first null frequency may be evaluated as $$f_{Null\,1} \approx \frac{c}{4L_{S1}\sqrt{\varepsilon_r}}$$

and the second null frequency may be evaluated as $$f_{Null\,2} \approx \frac{c}{4L_{S2}\sqrt{\varepsilon_r}},$$

where c is the speed of light, $\varepsilon_r$ is the relative dielectric constant of the substrate 501, $L_{S1}$ is the length of the longer open slot, and $L_{S2}$ is the length of the shorter open slot of the radiating patch.

Figure 6A:
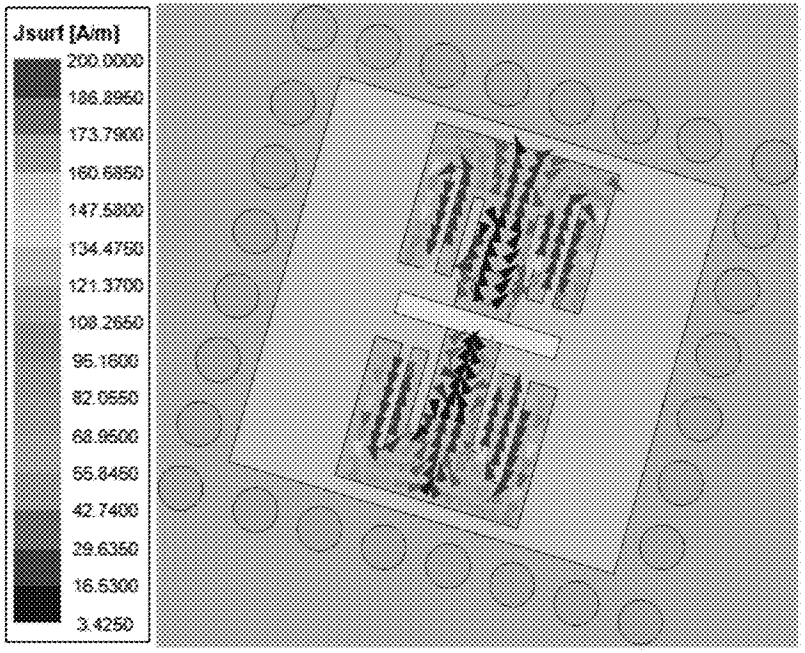
FIGS. 6A-6C illustrate the working mechanism of the generation of the first and second radiation nulls.
Figure 6B:
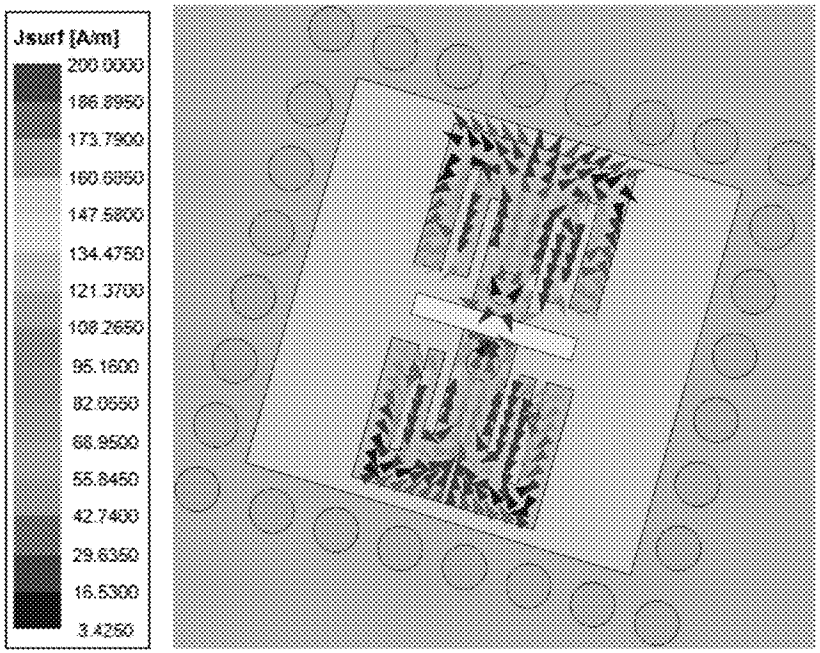
Figure 6C:
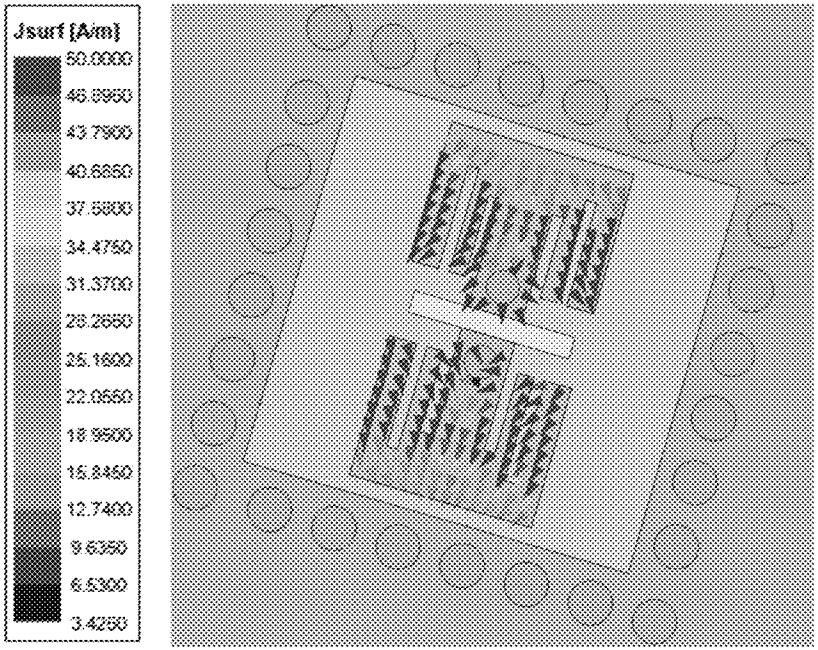

FIGS. 6A-6C illustrate the working mechanism of the generation of the first and second radiation nulls. FIG. 6A shows that at the first radiation null frequency ($f_{Null\ 1}$, 55.5 GHz), the currents concentrate at the conducting surface near the peripheral of the outer slots (longer slots). In contrast, in FIG. 6B at the second radiation null frequency ($f_{Null\ 2}$, 68 GHz), the currents concentrate at that of the inner slots (shorter slots). At these two frequencies, the induced currents flow in opposite directions, thus causing little radiation. FIG. 6C shows that the currents at the operating frequency are in the same direction and the antenna radiates properly.

Referring back to FIGS. 5A and 5B. The U-shaped hairpin lines 513, 514 may be configured to have lengths ($L_{U1}$) equal to a quarter-wavelength of a third radiation null frequency to generate an additional (third) radiation null at the lower stop band of the antenna. Transmission in the lower stopband can therefore be considerably suppressed.

Figure 7:
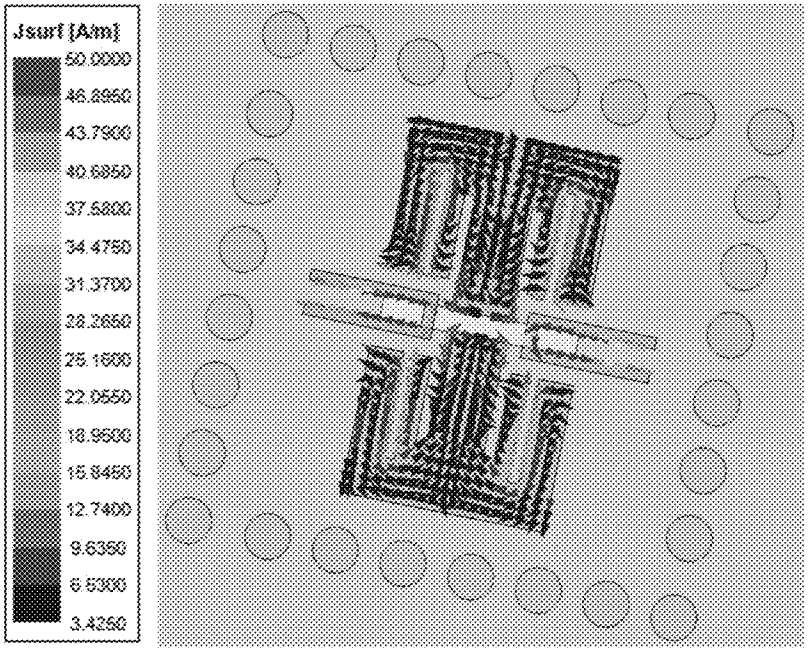
FIG. 7 depicts the current distributions on the radiating patches and U-shaped hairpin lines at the third radiation null frequency.

FIG. 7 depicts the current distributions on the radiating patches 511, 512 and U-shaped hairpin lines 513, 514 at the third radiation null frequency ($f_{Null\ 3}$, 52.5 GHz). It is observed that the U-shaped hairpin lines 513, 514 catch most of the energy, while little energy can be fed to the radiating patches 511, 512. Besides, the induced currents on the U-shaped hairpin lines 513, 514 have opposite directions. As a consequence, their radiations would counteract each other, thus generating a radiation null.

Referring back to FIGS. 5A and 5B. The feeding structure 540 may include a SIW for receiving/transmitting signals. The SIW may be formed with a plurality of conductive SIW vias extending through the second substrate 502. The plurality of SIW vias may be arranged in a stepped pattern (or 2-section) such that the SIW has a stepped waveguide impedance along a longitudinal axis (in x-direction) of the SIW. The stepped waveguide impedance of the SIW may be selected such that a distance ($DF_2$) between the coupling aperture 550 and an end of the feeding structure 540 is equal to 3/2 half-wavelength of a fourth null frequency to generate an additional (fourth) radiation null in the upper stop band of the antenna.

Figure 8B:
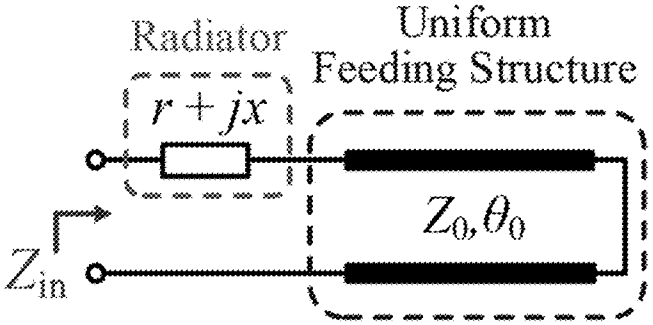
FIGS. 8A and 8B depict the top view and the equivalent circuit for a uniform feeding structure respectively.
Figure 8A:
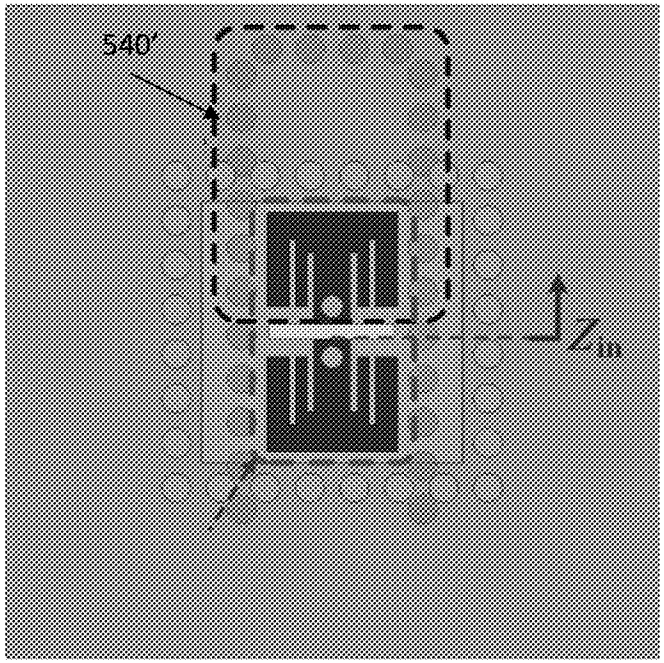
Figure 8D:
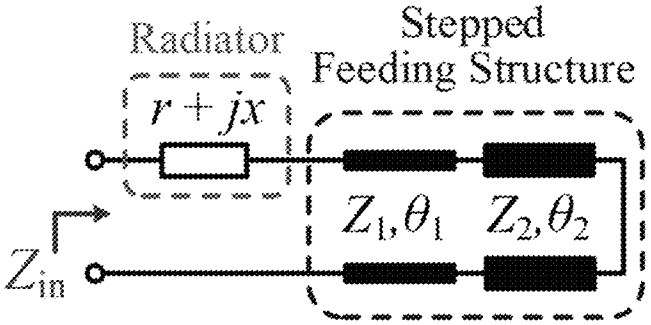
FIGS. 8C and 8D depict the top view and the equivalent circuit for a stepped feeding structure respectively.
Figure 8C:
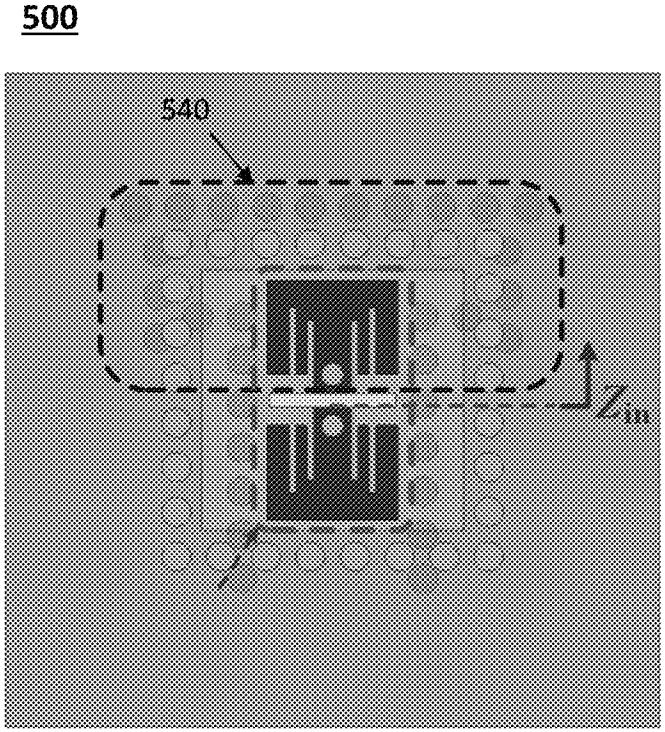

FIGS. 8A and 8B depict the top view and the equivalent circuit for a uniform feeding structure 540' respectively. FIGS. 8C and 8D depict the top view and the equivalent circuit for the stepped feeding structure 540 respectively.

As shown in FIGS. 8A and 8B, the equivalent circuit of the uniform feeding structure can be perceived as a resistance-reactance load (radiator) in series with a section of transmission line modeled by the feeding structure 540'. Eventually, the input impedance of the uniform feeding structure 540' can be given by:

$Z_{in}=r+jx+jZ_0 \tan \theta_0$, where r+jx is the resistance-reactance of the radiator, and $Z_0$ and $\theta_0$ are respectively the wave impedance and electrical length of the uniform feeding structure.

Note that at the operating (passing) frequency, to guarantee good impedance matching, $\theta_0 \approx \pi$. On the other hand, at stop band frequencies, it is preferable to have $$\theta_0 = \frac{\pi}{2}(2n+1),\ n = 0, 1, 2, 3 \ldots ,$$

to obtain $Z_{in}=\infty$ which is the condition for causing great impedance mismatch such that nearly all the feeding energy would be reflected back, leading to some radiation nulls. Therefore, to introduce a radiation null in the upper stopband, an appropriate adoption is $\theta_0=3\pi/2$.

Referring to FIGS. 8C and 8D. The equivalent circuit of the stepped feeding structure can be perceived as a resistance-reactance load in series with two sections of transmission line modeled by the stepped feeding structure 540. Eventually, the input impedance of the stepped feeding structure can be given by:

$$Z_{in} = r + jx + Z_1 \frac{jZ_2 \tan\theta_2 + jZ_1 \tan\theta_1}{Z_1 - Z_2 \tan\theta_1 \tan\theta_2}$$

where $Z_1(Z_2)$ and $\theta_1(\theta_2)$ are respectively the wave impedance and electrical length of the first (second) section of SIW feeding structure 540. For simplicity, let us set $\theta_1=\theta_2=\theta_A$. Then $Z_{in}=\infty$ relies on the condition that $z_1=z_2 \tan \theta_1 \tan \theta_2=z_2 \tan^2 \theta_A$ The two radiation nulls will be located at $$\theta_{A1} = \arctan\sqrt{\frac{Z_1}{Z_2}} \text{ and } \theta_{A2} = \pi - \arctan\sqrt{\frac{Z_1}{Z_2}}.$$

Therefore, through the adoption of stepped SIW feeding structure 540, one can have a lower wave impedance of the second section ($Z_2$) for smaller $\theta_{A2}$ to achieve the $Z_{in}=\infty$ condition.

Figure 9B:
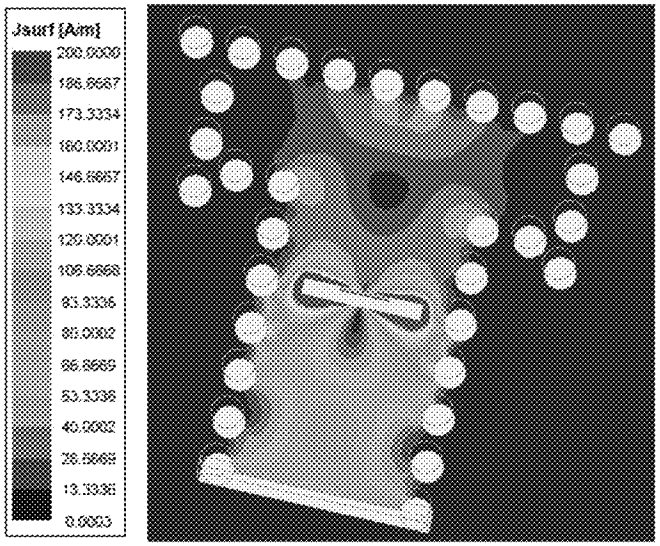
FIGS. 9A and 9B depict the simulated E-field and current distribution on the feeding structure coupled with the two mirrored radiating patches through the coupling aperture at the central working frequency respectively.
Figure 9A:
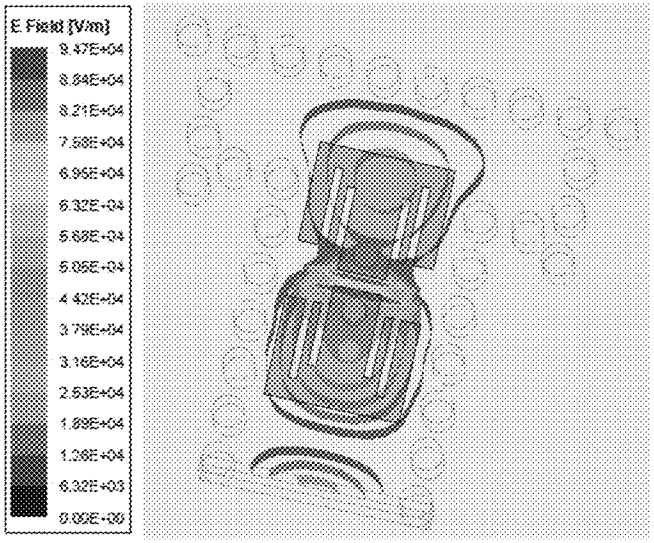
Figure 9D:
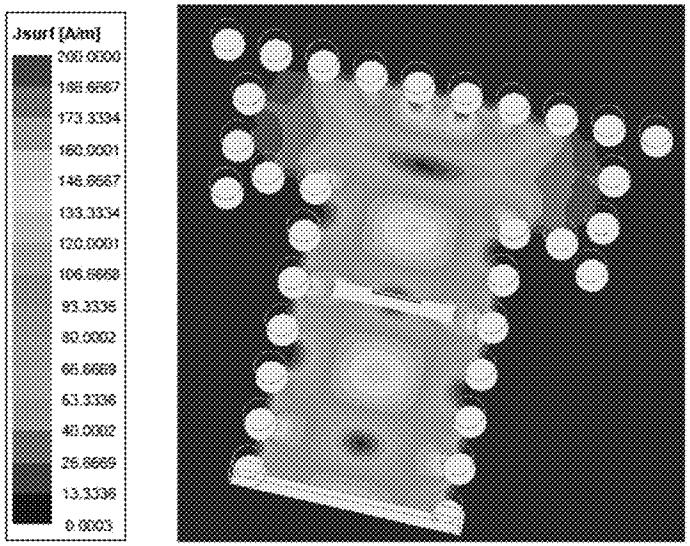
FIGS. 9C and 9D depict the simulated E-field and current distribution on the feeding structure coupled with the two mirrored radiating patches through the coupling aperture at the fourth radiation null frequency respectively.
Figure 9C:
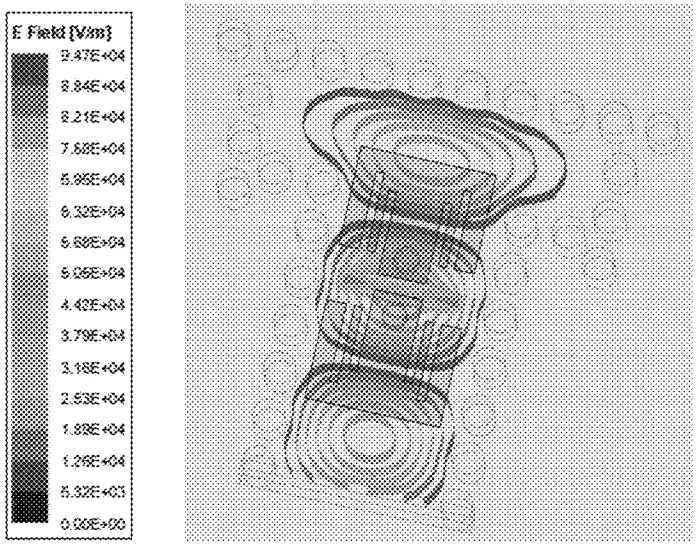
Figure 10A:
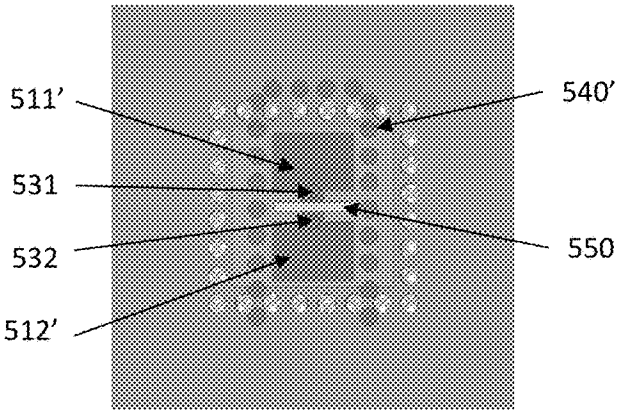
FIGS. 10A-10D show four comparative designs (Designs I-IV) respectively for investigating the operating mechanism of the filtering source.
Figure 10B:
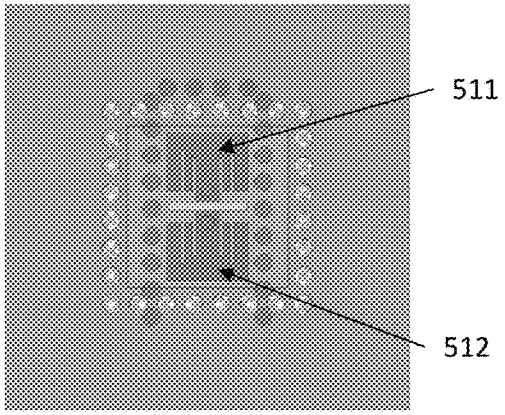
Figure 10C:
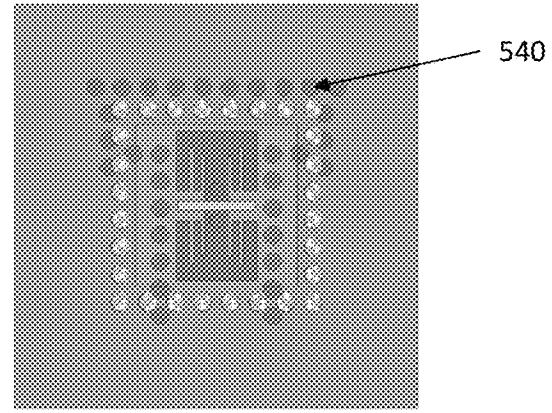
Figure 10D:
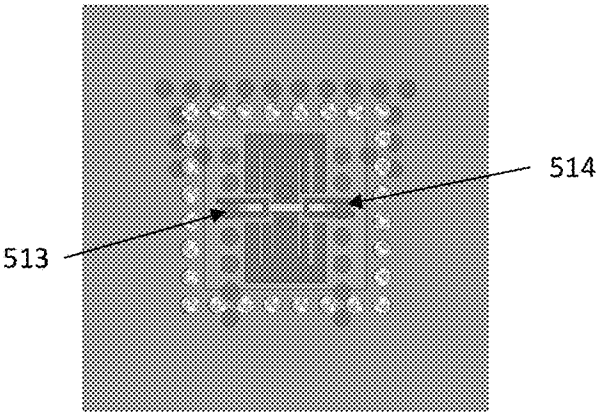

FIGS. 9A and 9B depict the simulated E-field and current distribution on the feeding structure 540 coupled with the two mirrored radiating patches 511, 512 through the coupling aperture 550 at the central working frequency respectively. FIGS. 9C and 9D depict the simulated E-field and current distribution on the feeding structure 540 coupled with the two mirrored radiating patches 511, 512 through the coupling aperture 550 at the fourth radiation null frequency respectively.

As seen in FIGS. 9A and 9B, at the central working frequency (60 GHz), the coupling aperture 550 is half wavelength away from the end of the feeding structure 540. In this case, the connected feeding structure 540 can be nearly perceived as a shorted circuit, and the coupling aperture 550 can be well excited. However, as seen in FIGS. 9C and 9D, at the fourth radiation null frequency ($f_{Null\ 4}$, 72.5 GHz), since the distance between the coupling aperture 550 and the end of the feeding structure 540 is around 3/2 half-wavelengths, the connected feeding structure 540 provides an open circuit at the vicinity of the coupling aperture 550. As a consequence, the coupling aperture 550 can hardly be excited, resulting in a radiation null.

To further illustrate the operating mechanism of the filtering source 500, four comparative designs (Designs I-IV) have been investigated, as shown in FIGS. 10A-10D respectively. As seen, for Design I, two symmetrical radiating patches 511', 512' connecting respectively two probe pins 531, 532 are differentially excited by the coupling aperture 550 and fed by a conventional feeding structure 540 with uniform wave impedance. On the basis of Design I, Design II is formed by etching two pairs of open slots with different lengths on each of the radiating patches to form the slotted patches 511, 512. On the basis of Design II, Design III is formed by modifying the feeding structure 540' to form the stepped feeding structure 540 to have stepped wave impedance, while the other parts keep the same as those of Design II. Finally, on the basis of Design III, Design IV (constituting the design of the present invention) is formed by printing a pair of U-shaped hairpin lines 513, 514 between the slotted patches 511, 512.

Figure 11A:
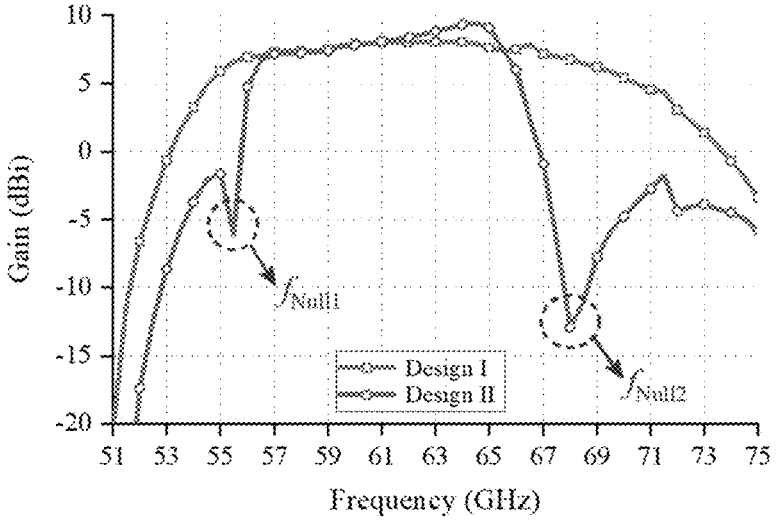
FIG. 11A illustrates the simulated gain of Design I in comparison with Design II.

FIG. 11A illustrates the simulated gain of Design I in comparison with Design II. As seen, Designs I and II almost experience the same antenna gain in the passing band. However, for Design II, after etching the slots, two radiation nulls show up on both sides of the passing band. The radiation null at $f_{Null\ 1}$ is generated by the longer slot ($L_{S1}$), while another radiation null at $f_{Null\ 2}$ is attributed to the shorter slot ($L_{S2}$).

Figure 11B:
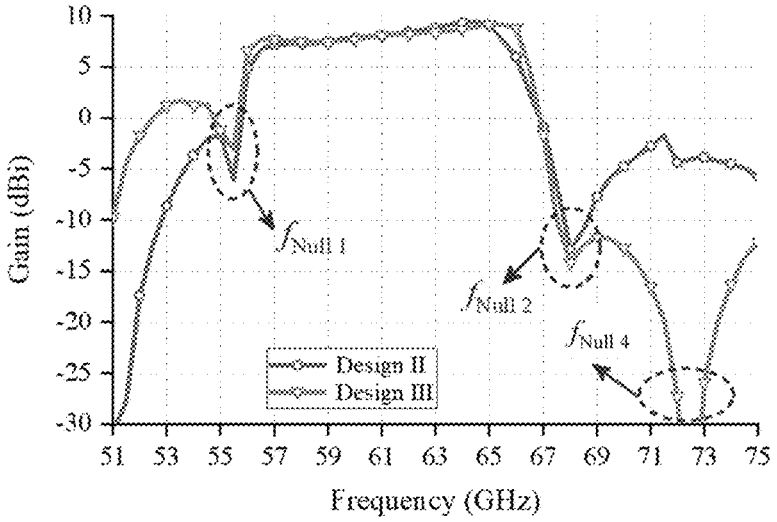
FIG. 11B illustrates the simulated realized gain of Design II in comparison with Design III.

FIG. 11B illustrates the simulated realized gain of Design II in comparison with Design III. As seen, due to the adoption of the stepped feeding structure, an additional radiation null ($f_{Null\ 4}$) is generated on the upper stopband and the suppression level has been greatly improved.

Figure 11C:
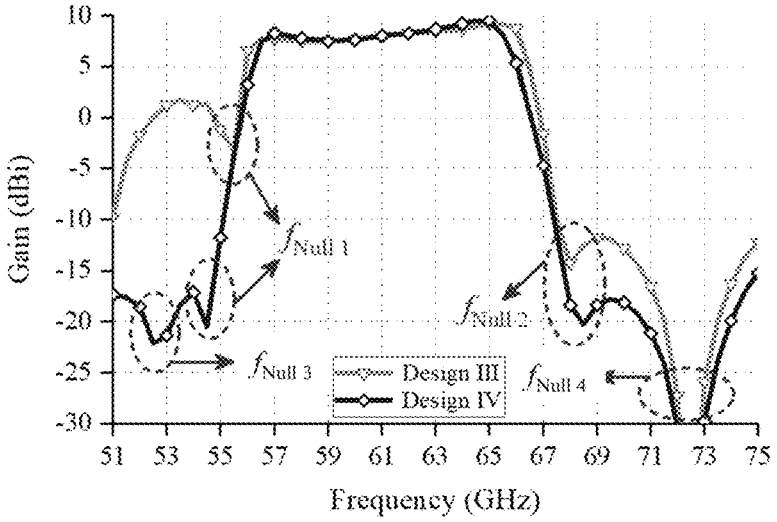
FIG. 11C illustrates the simulated realized gain of Design III in comparison with Design IV.

FIG. 11C illustrates the simulated realized gain of Design III in comparison with Design IV. As seen, a new radiation null ($f_{Null\ 3}$) appears, giving rise to significant improvement on the lower stopband suppression. These U-shaped hairpin lines work at half-wavelength resonance.

Figure 12A:
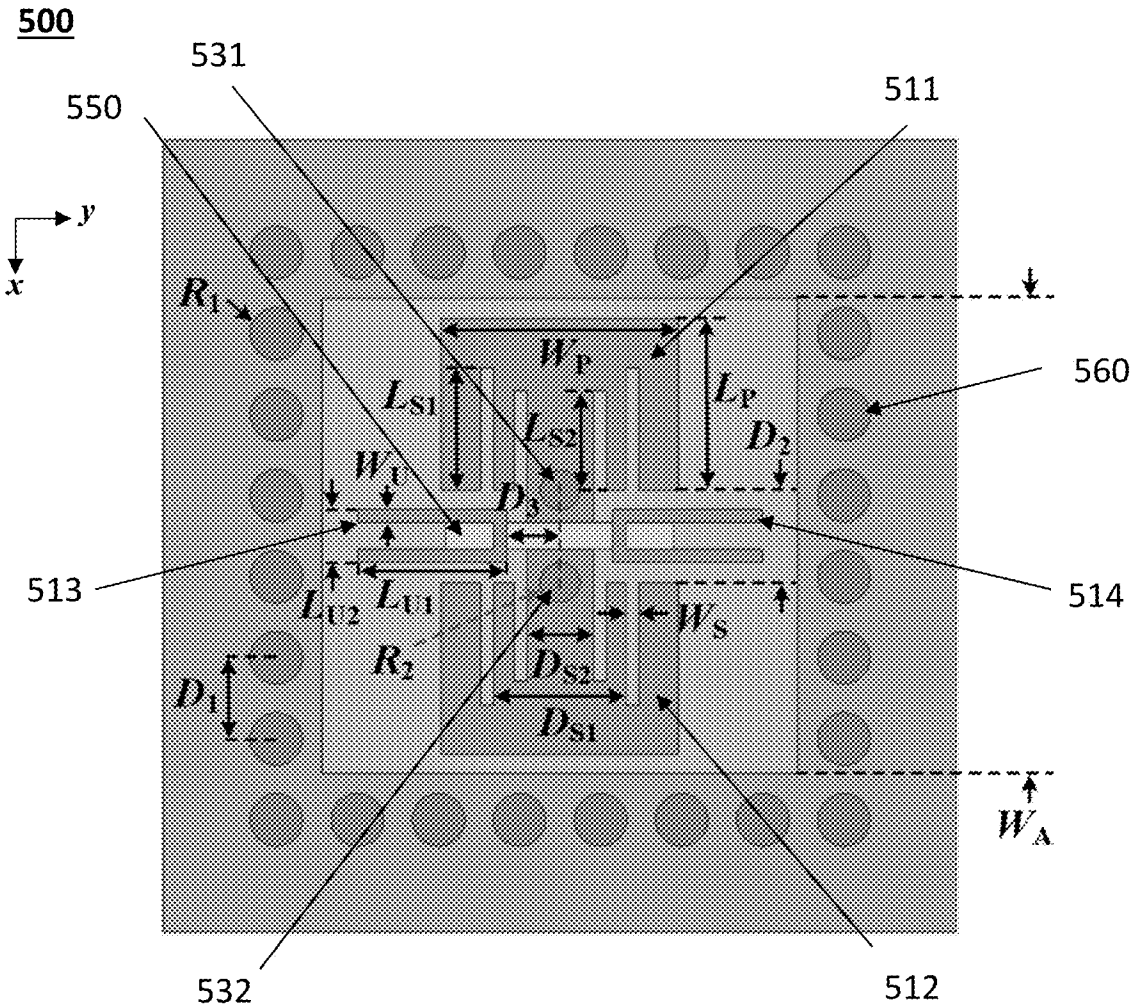
FIGS. 12A and 12B are top views of the first and second substrate layers of the filtering source FIGS. 5A and 5B respectively.
Figure 12B:
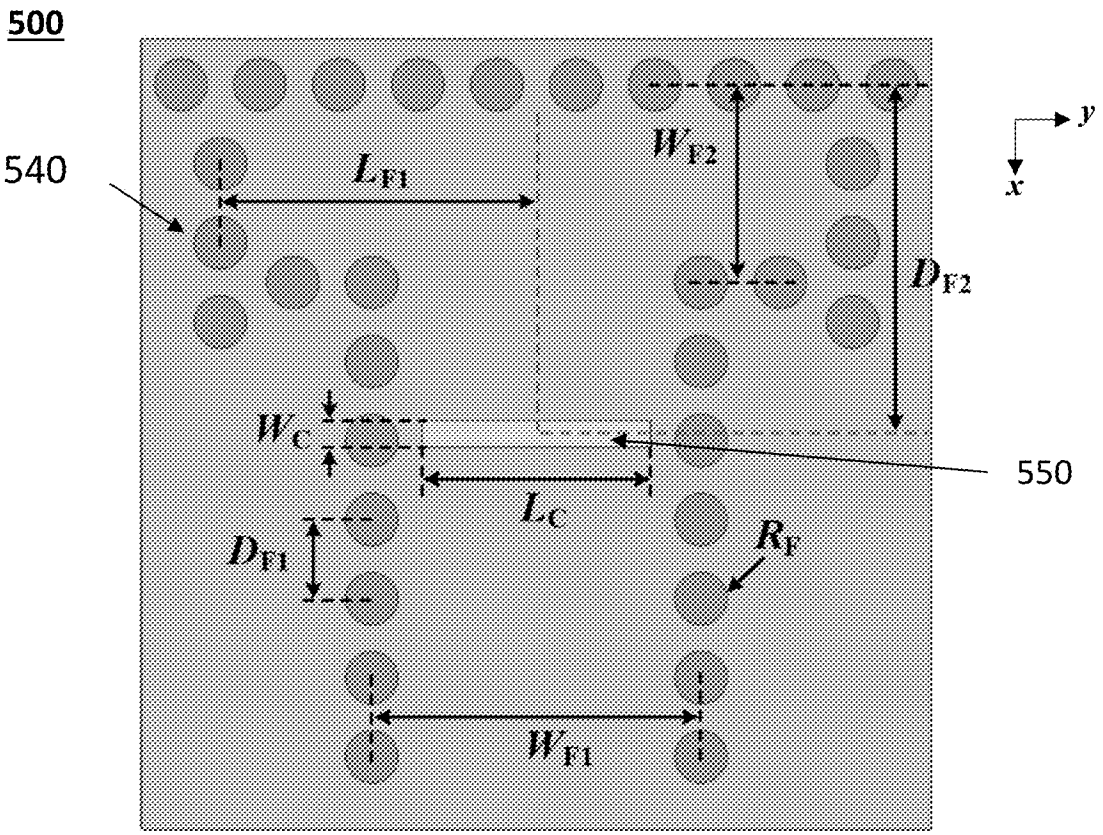

The filtering source 500 of FIGS. 5A and 5B may be constructed in a multilayer printed circuit board (PCB) or a layered structure based on dielectric substrates 501, 502 (e.g. Rogers RT/duroid 5880 with dielectric constant $\varepsilon_r$ of 2.2 and loss-tangent $\delta$ of 0.0009) bonded with a bonding film 503 (e.g Rogers COOLSPAN TECA bonding film 503). The substrate 501 thickness $h_1$ may be set to be 0.254 mm, while the substrate 502 thickness $h_2$ may be set to be 0.787 mm The bonding film 503 thickness $h_2$ may be set to be 0.05 mm FIGS. 12A and 12B are top views of the substrate 501 and substrate 502 of the filtering source 500 in FIGS. 5A and 5B respectively with the element sizes and distances between elements depicted. Referring to FIG. 12A. $W_A$ is the width of the conductive cavity 560. $R_1$ is the radius of the cavity vias. $D_1$ is the inter-via spacing for the conductive cavity 560. $W_P$ is the width and $L_P$ is the length of the radiating patch. $D_2$ is the separation between the two radiating patches 511, 512. $W_S$ is the width of the open slots of the radiating patch. $L_{S1}$ is the length of the longer open slot of the radiating patch. $L_{S2}$ is the length of the shorter open slot of the radiating patch. $D_{S1}$ is the inter-slot spacing between the longer open slots of each radiating patch. $D_{S2}$ is the inter-slot spacing between the shorter open slots of each radiating patch. $W_U$ is the line width of the U-shaped hairpin line. $L_{U1}$ is the length per pin of the U-shaped hairpin line. $L_{U2}$ is the inter-pin spacing of the U-shaped hairpin line. $D_3$ is the distance from an end of the U-shaped hairpin line to the center of coupling aperture 550 along the y-axis. $R_2$ is the radius of the posts for forming the probe.

Referring to FIG. 12B. $W_C$ is the width and $L_C$ is the length of the coupling aperture 550. $D_{F1}$ is the inter-via spacing for the SIW of the feeding structure 540. $D_{F2}$ is the distance from an end/edge of the SIW to the center of coupling aperture 550 along the x-axis. $R_F$ is the radius of the SIW vias. $L_{F1}$ is the distance from an end/edge of the SIW of the feeding structure 540 to the center of coupling aperture 550 along the y-axis. $W_{F1}$ is the first section width of the SIW of the feeding structure 540. $W_{F2}$ is the second section length of the SIW of the feeding structure 540.

Table I depicts the values for the above parameters for an exemplary filtering source 500.

TABLE I

Dimensions of the filtering source (Unit: mm)

| Parameter | $W_A$ | $W_P$ | $W_S$ | $W_U$ | $W_C$ | $W_{F1}$ | $W_{F2}$ | $L_P$ |
|---|---|---|---|---|---|---|---|---|
| Value | 3.6 | 1.7 | 0.1 | 0.1 | 0.2 | 2.5 | 1.5 | 1.2 |
| Parameter | $L_C$ | $L_{S1}$ | $L_{S2}$ | $L_{U1}$ | $L_{U2}$ | $L_{F1}$ | $D_1$ | $D_2$ |
| Value | 1.7 | 0.97 | 0.75 | 1.13 | 0.4 | 2.3 | 0.61 | 0.7 |
| Parameter | $D_3$ | $D_{S1}$ | $D_{S2}$ | $D_{F1}$ | $D_{F2}$ | $R_1$ | $R_2$ | $R_F$ |
| Value | 0.4 | 1 | 0.5 | 0.6 | 2.6 | 0.2 | 0.15 | 0.2 |

Figure 13:
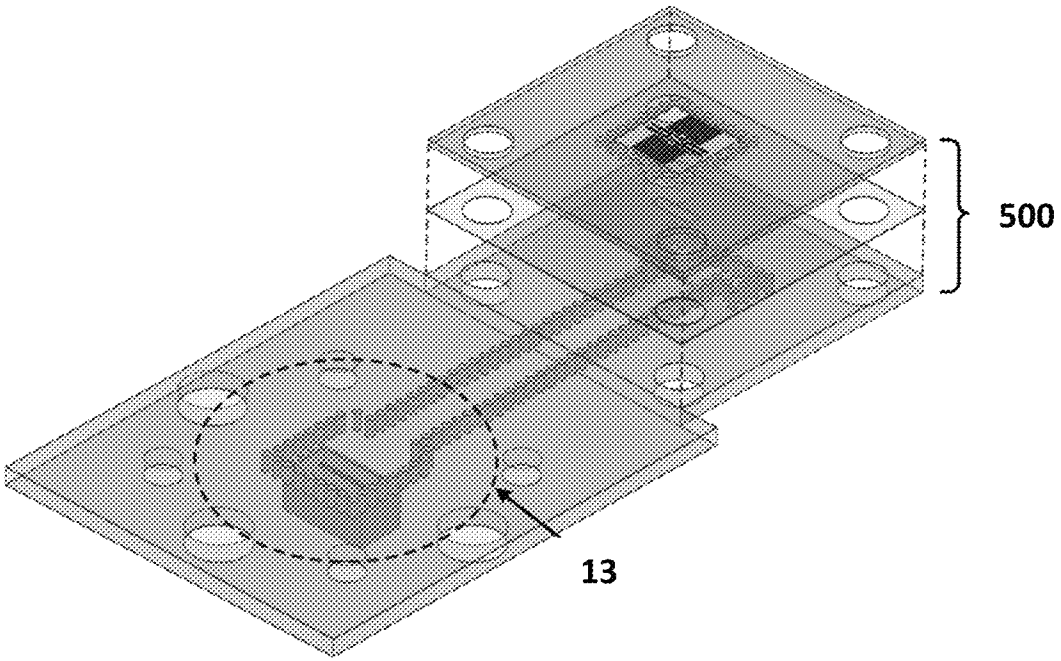
FIG. 13 depicts a geometry of the SIW-fed filtering source with a waveguide-to-SIW transition for measurement.

FIG. 13 depicts a geometry of the SIW-fed filtering source 500 with a waveguide-to-SIW transition 13 for measurement. For the purpose of eliminating the filtering response introduced by the transition and showing the real filtering performance of the filtering source 500, the transition has been deliberately designed to work in an ultra-wide frequency band.

Figure 14A:
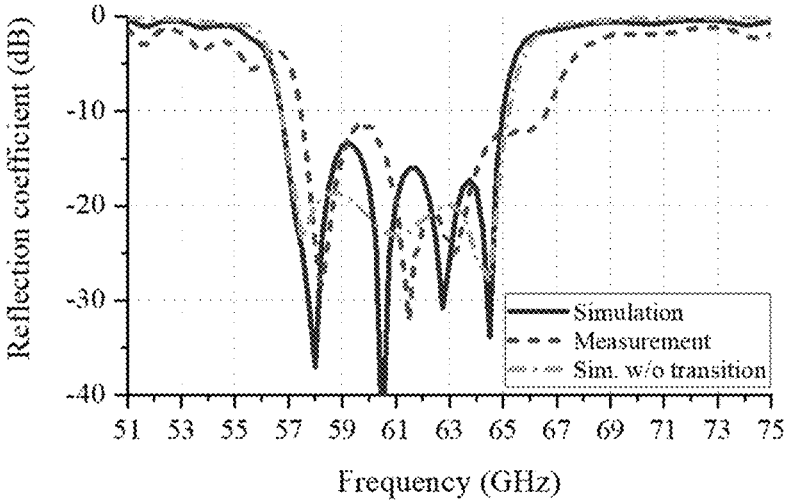
FIG. 14A illustrates the measured reflection coefficient of the filtering source in comparison to the simulated counterparts.
Figure 14B:
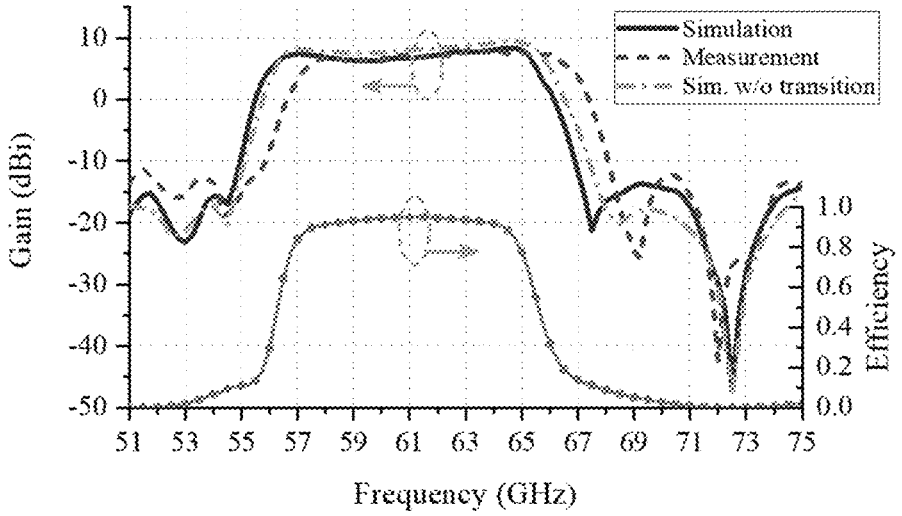
FIG. 14B illustrates the realized gain of the filtering source in comparison to the simulated counterparts.
Figure 15A:
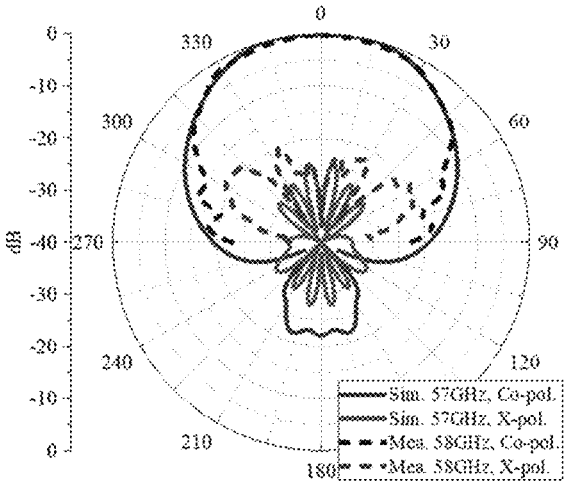
FIG. 15A illustrates the simulated and measured radiation patterns of the filtering source 500 operated at 57 GHz in H-plane.
Figure 15B:
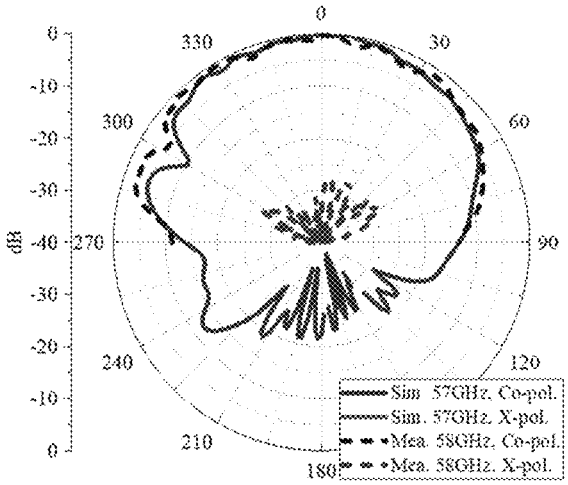
FIG. 15B illustrates the simulated and measured radiation patterns of the filtering source 500 operated at 57 GHz in E-plane.
Figure 15C:
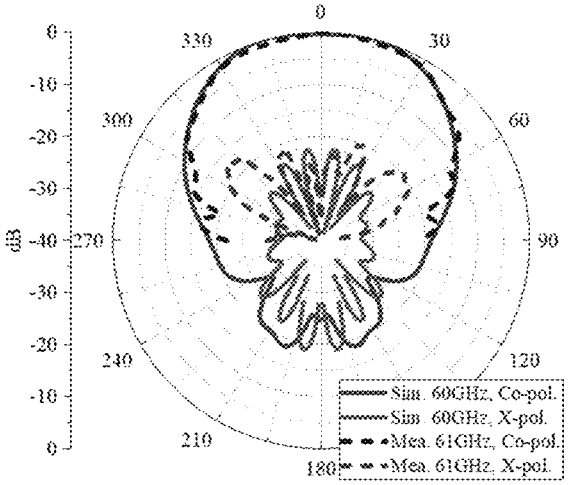
FIG. 15C illustrates the simulated and measured radiation patterns of the filtering source 500 operated at 60 GHz in H-plane.
Figure 15D:
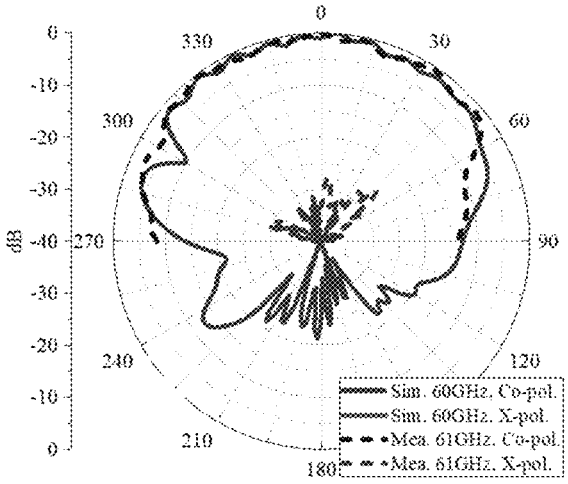
FIG. 15D illustrates the simulated and measured radiation patterns of the filtering source 500 operated at 60 GHz in E-plane.
Figure 15E:
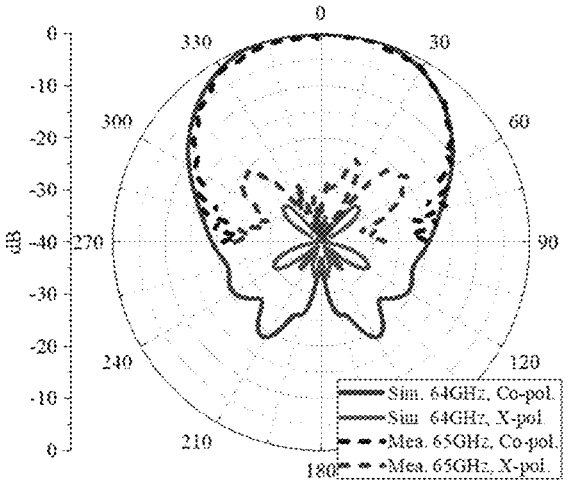
FIG. 15E illustrates the simulated and measured radiation patterns of the filtering source 500 operated at 64 GHz in H-plane.
Figure 15F:
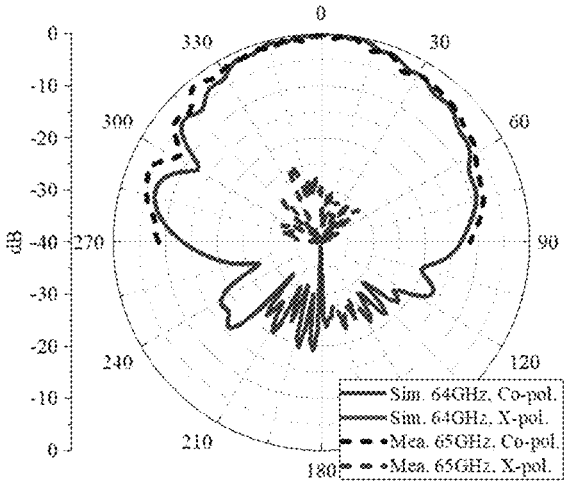
FIG. 15F illustrates the simulated and measured radiation patterns of the filtering source 500 operated at 64 GHz in E-plane.

FIG. 14A illustrates the measured reflection coefficient of the filtering source 500 in comparison to the simulated counterparts and FIG. 14B illustrates the realized gain of the filtering source 500 in comparison to the simulated counterparts. Note that the simulated results for the antenna without transition (i.e. Design IV) are plotted as well for reference. As seen, very little effect is caused by the transition. The measured −10-dB impedance bandwidth covers 14.7%, ranging from 57.5 GHz to 66.6 GHz. Minor discrepancies between the simulation and measurement may be attributed to the variation of dielectric constant of the substrates as well as the fabrication error. As shown, the filtering source 500 demonstrates excellent filtering gain response. The maximum realized gain of the antenna reaches 7.9 dBi in measurement, while the simulated one is 8.3 dBi. The measured out-of-band suppression level is greater than 19.1 dB. The simulated average in-band antenna efficiency for the antenna without transition is around 90%.

FIGS. 15A-15F illustrate the simulated and measured radiation patterns of the filtering source 500 operated at various frequency bands. The filtering source 500 has stable boresight radiation in addition to good front-to-back ratio. The measured cross-polarization levels are well below −17 dB. The minor asymmetry in the E-plane radiation patterns is due to the transition structure.

Figure 16:
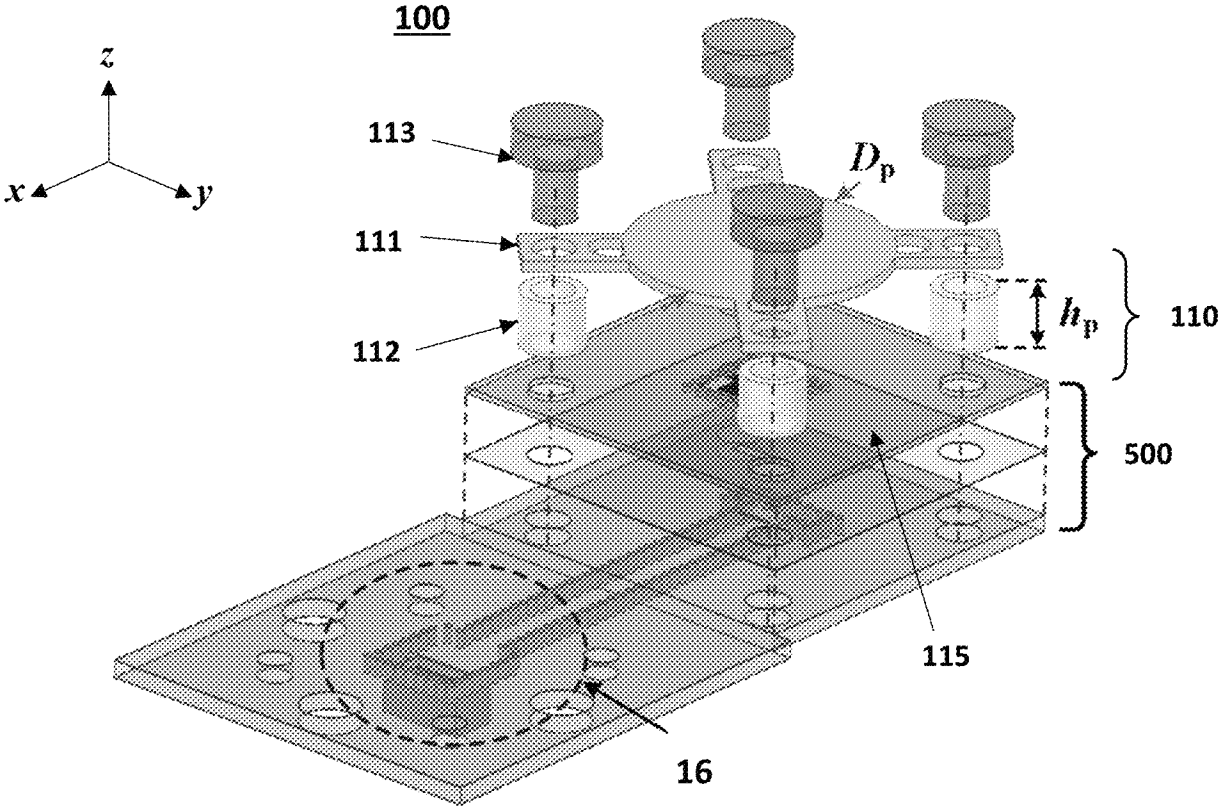
FIG. 16 depicts a geometry of the SIW-fed FPC filtering antenna with a waveguide-to-SIW transition for measurement.

FIG. 16 depicts a geometry of the SIW-fed FPC filtering antenna 100 with a waveguide-to-SIW transition 16 for measurement. Similarly, for the purpose of eliminating the filtering response introduced by the transition and showing the real filtering performance of the filtering source 500, the transition has been deliberately designed to work in an ultra-wide frequency band.

It should be understood that in practical applications, the SIW-fed FPC filtering antenna may be implemented with various transition circuits for connecting to various types of transmission lines, including but not limited to microstrip line, waveguide, or coplanar waveguide (CPW).

Figure 17A:
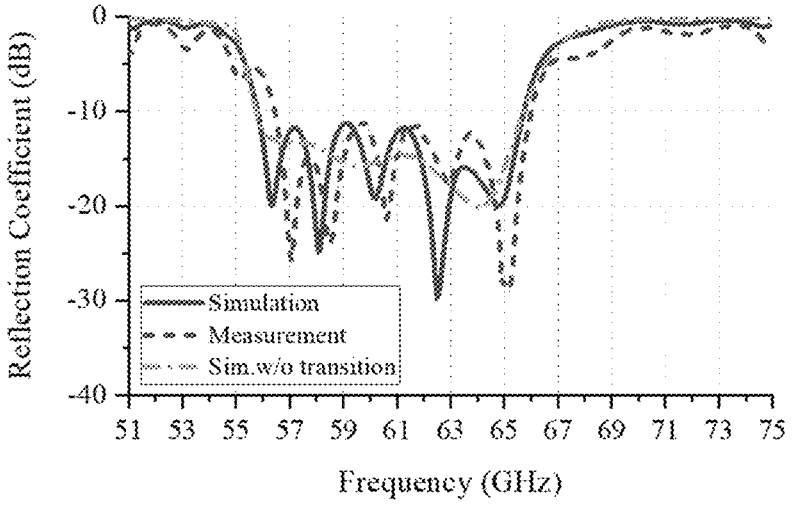
FIG. 17A shows the simulated and measured reflection coefficients of the SIW-fed FPC filtering antenna.
Figure 17B:
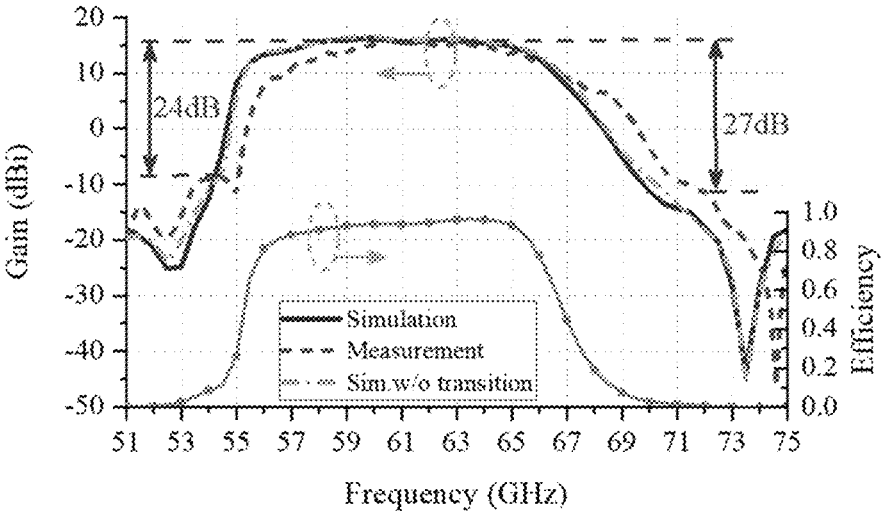
FIG. 17B shows the simulated and realized gain responses, and measured antenna efficiency of the SIW-fed FPC filtering antenna.
Figure 18A:
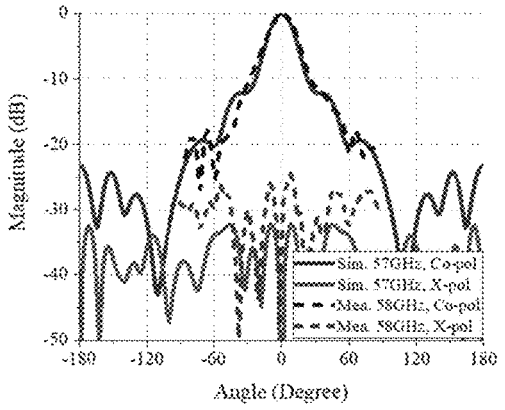
FIG. 18A shows the simulated and measured co-poloration and cross-poloration radiation patterns of the SIW-fed FPC filtering antenna operated at 57 GHz in E-plane.
Figure 18B:
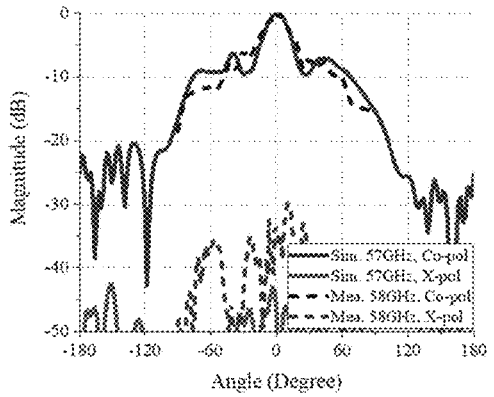
FIG. 18B shows the simulated and measured co-poloration and cross-poloration radiation patterns of the SIW-fed FPC filtering antenna operated at 57 GHz in H-plane.
Figure 18C:
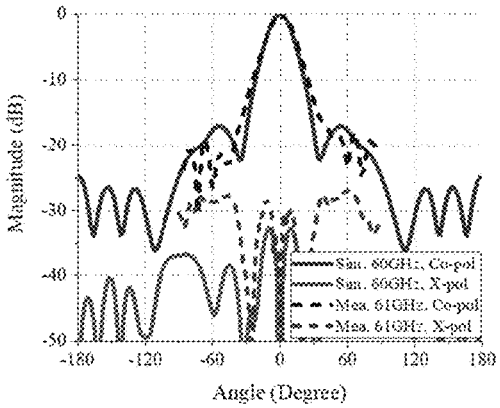
FIG. 18C shows the simulated and measured co-poloration and cross-poloration radiation patterns of the SIW-fed FPC filtering antenna operated at 60 GHz in E-plane.
Figure 18D:
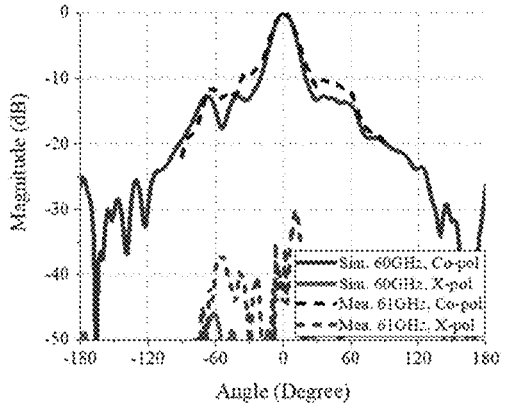
FIG. 18D shows the simulated and measured co-poloration and cross-poloration radiation patterns of the SIW-fed FPC filtering antenna operated at 60 GHz in H-plane.
Figure 18E:
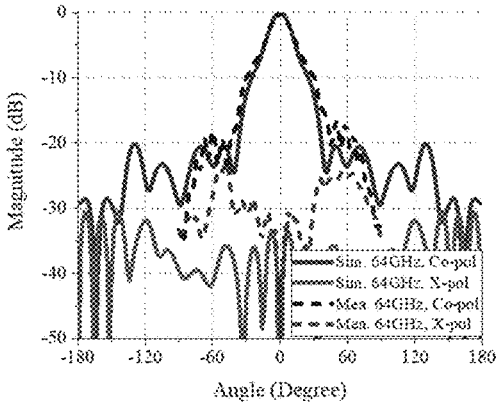
FIG. 18E shows the simulated and measured co-poloration and cross-poloration radiation patterns of the SIW-fed FPC filtering antenna operated at 64 GHz in E-plane.
Figure 18F:
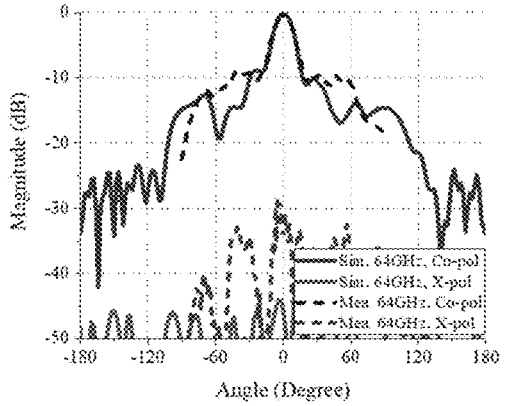
FIG. 18F shows the simulated and measured co-poloration and cross-poloration radiation patterns of the SIW-fed FPC filtering antenna operated at 64GHz in H-plane.

FIGS. 17A and 17B show the simulated and measured reflection coefficients, realized gain responses and antenna efficiency of the SIW-fed FPC filtering antenna 100. The simulated results for the antenna without transition are also plotted for comparison. As seen, the measured impedance bandwidth is 15.7% from 56.4 GHz to 66 GHz, while the simulated one is 16.5% from 55.7 GHz to 65.7 GHz. The antenna achieves maximum antenna gain of 16.4 dBi and 15.8 dBi respectively for simulation and measurement. The measured 3-dB gain bandwidth is 12.3% (58 GHz-65.6 GHz) compared to the simulated one of 15.3% (56.3 GHz-65.6 GHz). For the antenna without transition, its simulated average in-band antenna efficiency is around 86%. Good frequency selectivity is clearly observed. The measured suppression levels are respectively greater than 24 dB and 27 dB in the lower and upper stopbands.

FIGS. 18A-18F show the simulated and measured radiation patterns of the SIW-fed FPC filtering antenna 100. Stable boresight radiation can be seen over the operating band. The measured cross polarization level is greater than 23 dB in both E-plane and H-plane.

The foregoing description of the present invention has been provided for the purposes of illustration and description. It is not intended to be exhaustive or to limit the invention to the precise forms disclosed. Many modifications and variations will be apparent to the practitioner skilled in the art.

The apparatuses and the methods in accordance to embodiments disclosed herein may be implemented using computing devices, computer processors, or electronic circuitries and other programmable logic devices configured or programmed according to the teachings of the present disclosure. Computer instructions or software codes running in the computing devices, computer processors, or programmable logic devices can readily be prepared by practitioners skilled in the software or electronic art based on the teachings of the present disclosure.

All or portions of the methods in accordance to the embodiments may be executed in one or more computing devices including server computers, personal computers, laptop computers, mobile computing devices such as smartphones and tablet computers.

The embodiments were chosen and described in order to best explain the principles of the invention and its practical application, thereby enabling others skilled in the art to understand the invention for various embodiments and with various modifications that are suited to the particular use contemplated.

What is claimed is:

1. A wideband millimeter-wave a ntenna comprising:

a partially reflecting surface (PRS); and a filtering source configured to radiate a millimeter-wavelength electromagnetic wave and comprising:

a first substrate having a first substrate bottom ground plane on a bottom surfaceofthe first substrate;

a second substrate positioned underneath the first substrate and having a second substrate bottom ground plane on a bottom surfaceofthe second substrate;

radiating elements includinga pair of shorted radiating patches connected to the bottom ground plane of the first substrate through a pair of probe pins; and a substrate integrated waveguide (SIW) feeding structure formed in the second substrate and coupled to the pair of shorted radiating patches through a coupling a perture formed on the first substrate bottom ground plane; and wherein the wideband millimeter-wave antenna further comprises a first null frequency, a second null frequency, a third null frequency, a fourth null frequency, a first radiation null, a second radiation null, a third radiation null and a fourth radiation null;

wherein the first substrate bottom ground plane acts as a conductive reflecting plane configured to work with the PRS to forma Fabry-Perot cavity;

wherein the SIW feeding structure includesa plurality of SIW vias extending through the second substrate and arranged in a stepped pattern to provide a stepped waveguide impedance along a longitudinal axis of the SIW feeding structure; and wherein the stepped waveguide impedance is selected such that a distance between the coupling aperture and an end of the feeding structure is equal to 3/2 half-wavelength of the fourth null frequency atthe upper stopband for generating the fourth radiation null.

2. The wideband millimeter-wave antenna according to claim 1, wherein:

each of the shorted radiating patches is made of a conductive plate deposited on a top surface of the first substrate and differentially slotted to include a pair of longer open slots and a pair of shorter open slots;

the longer open slots have slot lengths equal to a quarter-wavelength of the first null frequency at the lower stop band for generating the first radiation null; and the shorter open slots have slot lengths equal to a quarter-wavelength of the second null frequency at the upper stopband for generating the second radiation null.

3. The wideband millimeter-wave antenna according to claim 1, wherein:

the radiating elements further comprise a pair of conductive U-shaped hairpin lines deposited on the top surface of the first substrate and positioned between the shorted radiating patches; and each of the conductive U-shaped hairpin lines is configured to have total lengths equal to a half-wavelength of the third null frequency at the lower stopband for generating the third radiation null.

4. The wideband millimeter-wave antenna according to claim 1, wherein the radiating elements are placed symmetrically in respect to the coupling aperture.

5. A wideband millimeter-wave antenna comprising:

a partially reflecting surface (PRS); and a filtering source configured to radiate a millimeter-wavelength electromagnetic wave and comprising:

a first substrate having a first substrate top ground plane on a top surface of the first substrate and a first substrate bottom ground plane on a bottom surface of the first substrate;

a second substrate positioned underneath the first substrate and having a second substrate top ground plane on a top surface of the second substrate and a second substrate bottom ground plane on a bottom surface of the second substrate;

a bonding film placed between the first substrate bottom ground plane and the second substrate top ground plane for bonding the first and second substrates together;

radiating elements including a pair of shorted radiating patches connected to the first substrate bottom ground plane through a pair of probe pins;

a substrate integrated waveguide (SIW) feeding structure formed in the second substrate and coupled to the pair of shorted radiating patches through a coupling aperture extending through the bonding film from the first substrate bottom ground plane to the second substrate top ground plane; and a conductive cavity formed in first substrate and configured to enclose the radiating elements for alleviating generation of surface wave;

wherein the wideband millimeter-wave antenna further comprises a first null frequency, a second null frequency, a third null frequency, a fourth null frequency, a first radiation null, a second radiation null, a third radiation null and a fourth radiation null; and wherein the first substrate top ground plane acts as a conductive reflecting plane configured to work with the PRS to form a Fabry-Perot cavity.

6. The wideband millimeter-wave antenna according to claim 5, wherein:

each of the shorted radiating patches is made of a conductive plate deposited on a top surface of the first substrate and differentially slotted to include a pair of longer open slots and a pair of shorter open slots;

the longer open slots have slot lengths equal to a quarter-wavelength of the first null frequency at the lower stopband for generating the first radiation null; and the shorter open slots have slot lengths equal to a quarter-wavelength of the second null frequency at the upper stopband for generating the second radiation null.

7. The wideband millimeter-wave antenna according to claim 5, wherein:

the radiating elements further comprise a pair of conductive U-shaped hairpin lines deposited on the top surface of the first substrate and positioned between the shorted radiating patches; and each of the conductive U-shaped hairpin lines is configured to have total lengths equal to a half-wavelength of the third null frequency at the lower stopband for generating the third radiation null.

8. The wideband millimeter-wave antenna according to claim 5, wherein:

the SIW feeding structure includes a plurality of SIW vias extending through the second substrate and arranged in a stepped pattern to provide a stepped waveguide impedance along a longitudinal axis of the SIW feeding structure; and the stepped waveguide impedance is selected such that a distance between the coupling aperture and an end of the feeding structure is equal to 3/2 half-wavelength of the fourth null frequency at the upper stopband for generating the fourth radiation null.

9. The wideband millimeter-wave antenna according to claim 5, wherein the radiating elements are placed symmetrically in respect to the coupling aperture.

* * * * *